US005327521A

United States Patent [19]

Savic et al.

[11] Patent Number: 5,327,521

[45] Date of Patent: Jul. 5, 1994

[54] SPEECH TRANSFORMATION SYSTEM

[75] Inventors: Michael I. Savic, Ballston Lake, N.Y.; Seow-Hwee Tan, Glendale, Calif.; Il-Hyun Nam, Seoul, Rep. of Korea

[73] Assignee: The Walt Disney Company, Burbank, Calif.

[21] Appl. No.: 114,603

[22] Filed: Aug. 31, 1993

Related U.S. Application Data

[63] Continuation of Ser. No. 845,375, Mar. 2, 1992, abandoned.

[51] Int. Cl.[5] ..... G10L 3/00

[52] U.S. Cl. ..... 395/2.81; 395/2.12; 395/2

[58] Field of Search ..... 381/61, 62, 36–40, 381/43, 45, 49, 50, 53, 54; 395/2.67, 2, 2.7, 2.79, 2.81, 2.87, 2.12

[56] References Cited

U.S. PATENT DOCUMENTS

| | | | |
|---|---|---|---|
| 4,058,676 | 11/1987 | Wilkes et al. | 395/2.12 |
| 4,400,591 | 8/1983 | Jennings et al. | 381/61 |
| 4,667,340 | 5/1987 | Arjmand et al. | 381/31 |
| 4,683,588 | 7/1987 | Goldberg | 381/61 |
| 4,815,135 | 3/1989 | Taguchi | 381/37 |
| 4,827,516 | 5/1989 | Tsukahara et al. | 381/36 |
| 4,856,068 | 8/1989 | Quatieri et al. | 381/47 |
| 4,864,626 | 9/1989 | Yang | 381/61 |
| 4,885,790 | 12/1989 | McAulay et al. | 381/36 |
| 4,937,873 | 6/1990 | McAulay et al. | 381/51 |
| 5,029,211 | 7/1991 | Ozawa | 381/36 |
| 5,113,449 | 5/1992 | Blanton et al. | 381/51 |

FOREIGN PATENT DOCUMENTS

| | | | |
|---|---|---|---|
| 0285276 | 5/1988 | European Pat. Off. | G10L 7/00 |
| WO8605617 | 9/1986 | PCT Int'l Appl. . | |

OTHER PUBLICATIONS

ICASSP'91 (1991 International Conference on Acoustics, Speech and Signal Processing, Toronto, Ontario, 14–17 May 1991), vol. 2, IEEE, (New York, US), M. ABE: "A segment-based approach to voice conversion", pp. 765–768, see p. 765, right-hand column, lines 2–28.

ICASSP'88 (1988) International Conference on Acoustics, Speech, and Signal Processing, New York, 11–14 Apr. 1988), vol. 1, IEEE, (New York, US), V. Goncharoff et al.: "Adaptive speech modification by spectral warping", pp. 343–346, see paragraph 2: Spectral envelope modification, figure 1.

Systems and Computers in Japan, vol. 21, No. 10, 1990 (New York, US), M. Abe et al.: "A speech modification method by signal reconstruction using short-tern Fourier transform", pp. 26–33, see figure 1.

IEEE Transactions on Acoustics, Speech, and Signal Processing, vol. ASSP-28, No. 1, Feb. 1980, (New York, US), R. E. Crochiere: "A weighted overlap-add method of short-time Fourier analysis/synthesis", pp. 99–102, see abstract: figure 2.

Onzieme Colloque sur le Traitement du Signal et des Images (Nice, 1–5 Jun. 1987), Gretsi, (Paris, FR), J. Crestel et al.: "Un systeme pour l'amelioration des communications en plongee profonde", pp. 435–438, see figure 2.

(List continued on next page.)

*Primary Examiner*—David D. Knepper

*Attorney, Agent, or Firm*—Pretty, Schroeder, Brueggemann & Clark

[57] ABSTRACT

A high quality voice transformation system and method operates during a training mode to store voice signal characteristics representing target and source voices. Thereafter, during a real time transformation mode, a signal representing source speech is segmented into overlapping segments, analyzed to separate the excitation spectrum from the tone quality spectrum. A stored target tone quality spectrum is substituted for the source spectrum and then convolved with the actual source speech excitation spectrum to produce a transformed speech signal having the word and excitation content of the source, but the acoustical characteristics of a target speaker. The system may be used to enable a talking, costumed character, or in other applications where a source speaker wishes to imitate the voice characteristics of a different, target speaker.

11 Claims, 6 Drawing Sheets

OTHER PUBLICATIONS

A. Oppenheim and R. Schafer, *Digital Signal Processing*, Prentice-Hall, (1975), pp. 284-327.

L. Rabiner and R. Schafer, *Digital processing of speech Signals*, Prentice-Hall, (1978), pp. 303-306.

L. Rabiner and R. Schafer, *Digital Processing of Speech Signals*, Prentice-Hall, (1978), pp. 411-413.

S. Roucos and A. Wilgus, "High Quality Time-Scale Modification for Speech," *IEEE International Conference on Acoustic, Speech and Signal Processing*, CH2118-8/85/0000-0493, pp. 493-496, (Mar. 26-29, 1985).

M. Abe, S. Nakamura, K. Shikano, and H. Kuwabara, "Voice Conversion Through Vector Quantization", *IEEE International Conference on Acoustics, Speech and Signal Processing*, (Apr. 1988), pp. 655-658.

M. Abe, S. Tamura and H. Kuwabara, "A New Speech Modification Method by Signal Reconstruction", *IEEE International Conference on Acoustic, Speech, and Signal Processing*, (Apr. 1989), pp. 592-595.

L. Almeida and F. Silva, "Variable-Frequency Synthesis: An Improved Harmonic Coding Scheme", *Proceedings of the IEEE International Conference on Acoustic, Speech, and Signal Processing*, (Mar. 1984), pp. 27.5.1-27.5.4.

H. Bonneau and J. Gauvain, "Vector Quantization for Speaker Adaption", *Proceedings of the IEEE International Conference on Acoustic, Speech and Signal Processing*, (Apr. 1987), pp. 1434-1437.

D. Childers, "Talking Computers: Replacing Mel Blanc", *Computers in Mechanical Engineering*, vol. 6, No. 2 (Sep./Oct. 1987), pp. 22-31.

D. Childers, K. Wu, D. Hicks, and B. Yegnanarayana, "Voice Conversion", *Speech Communication 8*, (1989), pp. 147-158.

D. Childers, B. Yegnanarayana, and K. Wu, "Voice Conversion: Factors Responsible for Quality", *Proceedings of the IEEE International Conference on Acoustic, Speech, and Signal Processing*, (Mar. 1985) pp. 748-751.

D. Griffin and J. Lim, "Signal Estimation from Modified Short-Time Fourier Transform", *IEEE Transactions on Acoustics, Speech, and Signal Processing*, vol. ASSP-32, No. 2, (Apr. 1984), pp. 236-243.

J. Jaschul, "An Approach to Speaker Normalization for Automatic Speech Recogniation", *Proceedings of the IEEE International Conference on Acoustic, Speech, and Signal Processing*, (Apr. 1979) pp. 235-238.

M. Portnoff, "Time-Scale Modification of Speech Based on Short-Time Fourier Analysis", *IEEE Transactions on Acoustics, Speech, and Signal Processing*, vol. ASSP-29, No. 3, (Jun. 1981), pp. 374-390.

T. Quatieri and R. McAulay, "Apeech Transformations Based on a Sinusoidal Representation", *IEEE Transactions on Acoustics, Speech, and Signal Processing*, vol. ASSP-34, No. 6, (Dec. 1986), pp. 1449-1461.

M. Ross, H. Shaffer, A. Cohen, F. Freudberg and H. Manley, "Average Magnitude Difference Function Pitch Extractor", *IEEE Transactions on Acoustics, Speech, and Signal Processing*, vol. ASSP-30, No. 5, (Oct. 1974), pp. 353-362.

S. Seneff, "System to Independently Modify Excitation and/or Spectrum of Speech Waveform Without Explicit Pitch Extraction", *IEEE Transactions on Acoustics, Speech, and Signal Processing*, vol. ASSP-30 No. 4, (Aug. 1982), pp. 566-578.

S. Seneff, "Speech Transformation System (Spectrum and/or Excitation) Without Pitch Extraction", *Massachusette Institute of Technology, Lincoln Laboratory*, Technical Report 541, (Jul. 1980).

L. Rabiner, M. Cheng, A. Rosenberg, and C. McGonegal, "A Comparative Performance Study of Several Pitch Detection Algorithms", *IEEE Transactions on Acoustics, Speech, and Signal Processing, vol. 24, No. 5, (Oct. 1976), pp. 399-404.*

J. Markel and A. Gray, Jr., *linear prediction of Speech*, Springer-Verlag, (1982).

WINDOW FUNCTIONS 42

DIGITAL SAMPLING 40

SEGMENTATION 42

TRAINING STEP 54

CODEBOOK GENERATION 122

GENERATE MAPPING CODEBOOK 124

INITIALIZE y(n) 210

SPEECH TRANSFORMATION SYSTEM

This application is a continuation of a prior pending application, application Ser. No. 07/845,375, filed on Mar. 2, 1992, now abandoned.

COPYRIGHT AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records; but otherwise reserves all copyright rights whatsoever.

BACKGROUND OF THE INVENTION

In 1928 Mickey Mouse was introduced to the public in the first "talking" animation film entitled, "Steamboat Willy". Walt Disney, who created Mickey Mouse, was also the voice of Mickey Mouse. Consequently, when Walt Disney died in 1966 the world lost a creative genius and Mickey Mouse lost his voice.

It is not unusual to discover during the editing of a dramatic production that one or more scenes are artistically flawed. Minor background problems can sometimes be corrected by altering the scene images. However, if the problem lies with the performance itself or there is a major visual problem, a scene must be done over. Not only is this expensive, but occasionally an actor in the scene will no longer be available to redo the scene. The editor must then either accept the artistically flawed scene or make major changes in the production to circumvent the flawed scene.

A double could typically be used to visually replace a missing actor in a scene that is being redone. However, it is extremely difficult to convincingly imitate the voice of a missing actor.

A need thus exists for a high quality voice transformation system that can convincingly transform the voice of any given source speaker to the voice of a target speaker. In addition to its use for motion picture and television productions, a voice transformation system would have great entertainment value. People of all ages could take great delight in having their voices transformed to those of characters such as Mickey Mouse or Donald Duck or even to the voice of their favorite actress or actor. Alternatively, an actor dressed in the costume of a character and imitating a character could be even more entertaining if he or she could speak the voice of the character.

A great deal of research has been conducted in the field of voice transformation and related fields. Much of the research has been directed to transformation of source voices to a standardized target voice that can be more easily recognized by computerized voice recognition systems.

A more general speech transformation system is suggested by an article by Masanobu Abe, Satoshi Nakamura, Kiyohiro Shikano and Hisao Kuwabara, "Voice Conversion Through Vector Quantization," *IEEE International Conference on Acoustics, Speech and Signal Processing,* (April 1988), pp. 655–658. While the disclosed method produced a voice transformation, the transformed target voice was less than ideal. It contained a considerable amount of distortion and was recognizable as the target voice less than ⅔ of the time in an experimental evaluation.

SUMMARY OF THE INVENTION

A high quality voice transformation system and method in accordance with the invention provides transformation of the voice of a source speaker to the voice of a selected target speaker. The pitch and tonal qualities of the source voice are transformed while retaining the words and voice emphasis of the source speaker. In effect the vocal chords and glottal characteristics of the target speaker are substituted for those of the source speaker. The words spoken by the source speaker thus assume the voice characteristics of the target speaker while retaining the inflection and emphasis of the source speaker. The transformation system may be implemented along with a costume of a character to enable an actor wearing the costume to speak with the voice of the character.

In a method of voice transformation in accordance with the invention, a learning step is executed wherein selected matching utterances from source and target speakers are divided into corresponding short segments. The segments are transformed from the time domain to the frequency domain and representations of corresponding pairs of smoothed spectral data are stored as source and target code books in a table. During voice transformation the source speech is divided into segments which are transformed to the frequency domain and then separated into a smoothed spectrum and an excitation spectrum. The closest match of the smoothed spectrum for each segment is found in the stored source code book and the corresponding target speech smoothed spectrum from the target code book is substituted therefore in a substitution or transformation step. This substituted target smoothed spectrum is convolved with the original source excitation spectrum for the same segment and the resulting transformed speech spectrum is transformed back to the time domain for amplification and playback through a speaker or for storage on a recording medium.

It has been found advantageous to represent the original speech segments as the cepstrum of the Fourier transform of each segment. The source excitation spectrum is attained by dividing or deconvolving the transformed source speech spectrum by a smoothed representation thereof.

A real time voice transformation system includes a plurality of similar signal processing circuits arranged in sequential pipelined order to transform source voice signals into target voice signals. Voice transformation thus appears to be instantaneous as heard by a normal listener.

BRIEF DESCRIPTION OF THE DRAWINGS

A better understanding of the invention may be had from a consideration of the following Detailed Description, taken in conjunction with the accompanying drawings in which.

DETAILED DESCRIPTION OF THE INVENTION

Figure 1:
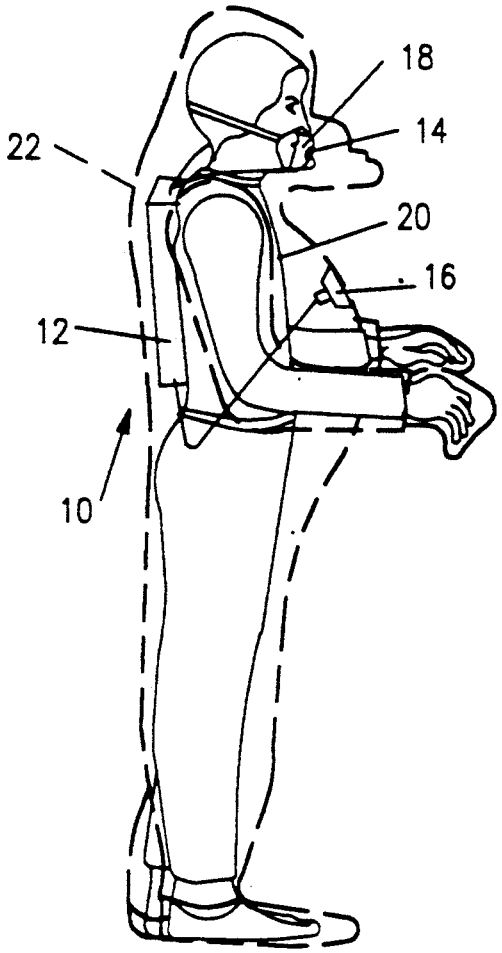
FIG. 1 is a pictorial representation of an actor wearing a costume that has been fitted with a voice transformation system in accordance with the invention.

Referring now to FIG. 1, a voice transformation system 10 in accordance with the invention includes a battery powered, portable transformation processor 12 electrically coupled to a microphone 14 and a speaker 16. The microphone 14 is mounted on a mask 18 that is worn by a person 20. The mask 18 muffles or contains the voice of the person 20 to at least limit, and preferably block, the extent to which the voice of the person 20 can be heard beyond a costume 22 which supports the speaker 16.

With the voice contained within costume 22, the person 20 can be an actor portraying a character such as Mickey Mouse® or Pluto® that is depicted by the costume 22. The person 20 can speak into microphone 14, have his or her voice transformed by transformation processor 12 into that of the depicted character. The actor can thus provide the words and emotional qualities of speech, while the speaker 16 broadcasts the speech with the predetermined vocal characteristics corresponding to the voice of a character being portrayed.

The voice transformation system 10 can be used for other applications as well. For example, it might be used in a fixed installation where a person selects a desired character, speaks a training sequence that creates a correspondence between the voice of the person and the voice of the desired character, and then speaks randomly into a microphone to have his or her voice transformed and broadcast from a speaker as that of the character. Alternatively, the person can be an actor substituting for an unavailable actor to create a voice imitation that would not otherwise be possible. The voice transformation system 10 can thus be used to recreate a defective scene in a movie or television production at a time when an original actor is unavailable. The system 10 could also be used to create a completely new character voice that could subsequently be imitated by other people using the system 10.

Figure 2:
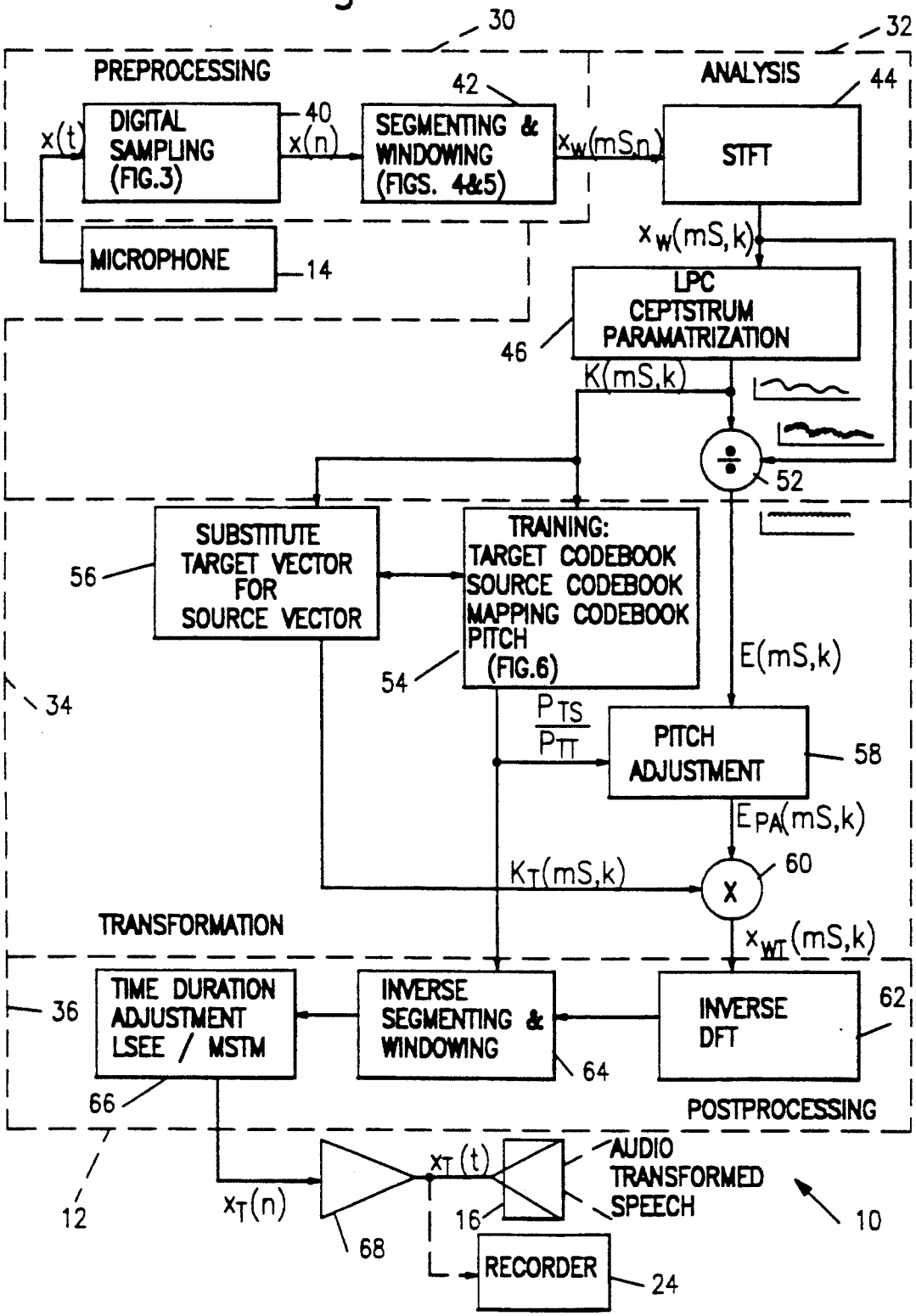
FIG. 2 is a block diagram representation of a method of transforming a source voice to a different target voice in accordance with the invention.

Referring now to FIG. 2, a voice transformation system 10 for transforming a source voice into a selected target voice includes microphone 14 picking up the acoustical sounds of a source voice and transducing them into a time domain analog signal x(t), a voice transformation processor 12 and a speaker 16 that 10 receives a transformed target time domain analog voice signal $X_T(t)$ and transduces the signal into acoustical waves that can be heard by people. Alternatively, the transformed speech signal can be communicated to some kind of recording device 24 such as a motion picture film recording device or a television recording device.

The transformation processor 12 includes a preprocessing unit or subsystem 30, an analysis unit or subsystem 32, a transformation unit or subsystem 34, and a post processing unit or subsystem 36.

The voice transformation system 10 may be implemented on any data processing system 12 having sufficient processing capacity to meet the real time computational demands of the transformation system 10. The system 12 initially operates in a training mode, which need not be in real time. In the training mode the system receives audio signals representing an identical sequence of words from both source and target speakers. The two speech signals are stored and compared to establish a correlation between sounds spoken by the source speaker and the same sounds spoken by the target speaker.

Thereafter the system may be operated in a real time transformation mode to receive voice signals representing the voice signals of the source speaker and use the previously established correlations to substitute voice signals of the target speaker for corresponding signals of the source speaker. The tonal qualities of the target speaker may thus be substituted for those of the source speaker in any arbitrary sequences of source speech while retaining the emphases and word content provided by the source speaker.

The preprocessing unit 30 includes a digital sampling step 40 and a segmenting and windowing step 42. The digital sampling step 40 digitally samples the analog voice signal x(t) at a rate of 10 kHz to generate a corresponding sampled data signal x(n). Segmenting and windowing step 42 segments the sample data sequences into overlapping blocks of 256 samples each with a shift distance of ¼ segment or 64 samples. Each sample thus appears redundantly in 4 successive segments. After segmentation, each segment is subjected to a windowing function such as a Hamming window function to reduce aliasing of the segment during a subsequent Fourier transformation to the frequency domain. The segmented and windowed signal is identified as $X_w(mS,n)$ wherein m is the segment size of 256, S is the shift size of 64 and n is an index into the sampled data value of each segment (0–255). The value mS thus indexes the starting point of each segment within the original sample data signal X(n).

The analysis unit 32 receives the segmented signal $X_w(mS,n)$ and generates from this signal an excitation signal E(k) representing the excitation of each segment and a 24 term cepstrum vector K(mS,k) representing a smoothed spectrum for each segment.

The analysis unit 32 includes a short time Fourier transform step 44 (STFT) that converts the segmented signal $X_w(mS,n)$ to a corresponding frequency domain signal $X_w(mS,k)$. An LPC cepstrum parametrization step 46 produces for each segment a 24 term vector K(mS,k) representing a smoothed spectrum of the voice signal represented by the segment.

A deconvolver 52 deconvolves the smoothed spectrum represented by the cepstrum vectors K(mS,k) with the original spectrum $X_W(mS,k)$ to produce an excitation spectrum E(k) that represents the emotional energy of each segment of speech.

The transformation unit 34 is operable during a training mode to receive and store the sequence of cepstrum vectors K(mS,k) for both a target speaker and a source speaker as they utter identical scripts containing word sequences designed to elicit all of the sounds used in normal speech. The vectors representing this training speech are assembled into target and source code books, each unique to a particular speaker. These code books, along with a mapping code book establishing a correlation between target and source speech vectors, are stored for later use in speech transformation. The average pitch of the target and source voices is also determined during the training mode for later use during a transformation mode.

The transformation unit 34 includes a training step 54 that receives the cepstrum vectors K(mS,k) to generate and store the target, source and mapping code books during a training mode of operation. Training step 54 also determines the pitch signals Ps for each segment so as to determine and store indications of overall average pitch for both the target and the source.

Thereafter, during real time transformation mode of operation, the cepstrum vectors are received by a substitute step 56 that accesses the stored target, source and mapping code books and substitutes a target vector for each received source vector. A target vector is selected that best corresponds to the same speech content as the source vector.

A pitch adjustment step 58 responds to the ratio of the pitch indication $P_{TS}$ for the source speech to the pitch indication $P_{TT}$ for the target speech determined by the training step 54 to adjust the excitation spectrum E(k) for the change in pitch from source to target speech. The adjusted signal is designated $E_{PA}(k)$. A convolver 60 then combines the target spectrum as represented by the substituted cepstrum vectors $K_T(mS,k)$ with the pitch adjusted excitation signal $E_{PA}(k)$ to produce a frequency domain, segmented transformed speech signal $X_{WT}(mS,k)$ representing the utterances and excitation of the source speaker with the glottal or acoustical characteristics of the target speaker.

The post processing unit responds to the transformed speech signal $X_{WT}(mS,k)$ with an inverse discrete Fourier transform step 62, an inverse segmenting and windowing step 64 that recombines the overlapping segments into a single sequence of sampled data and a time duration adjustment step 66 that uses an LSEE/MSTM algorithm to generate a time domain, nonsegmented sampled data signal $X_T(n)$ representing the transformed speech. A digital-to-analog converter and amplifier converts the sampled signal $X_T(n)$ to a continuous analog electrical signal $X_T(t)$.

Figure 3:
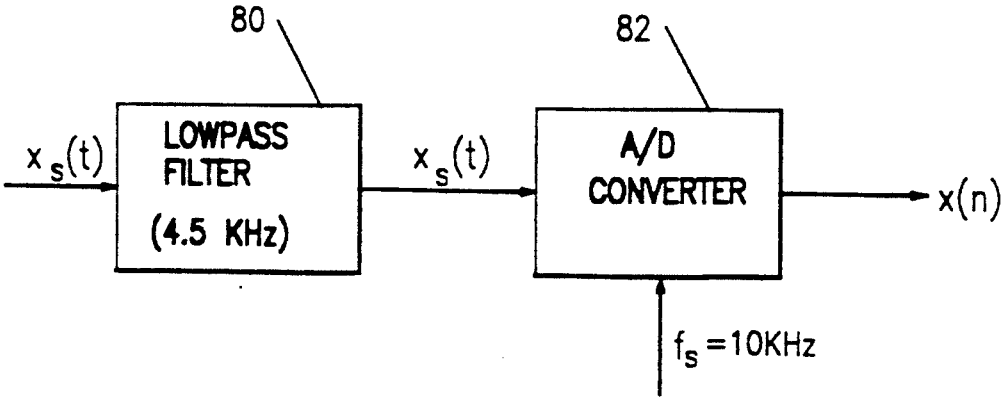
FIG. 3 is a block diagram representation of a digital sampling step used in the processor shown in FIG. 2.

Referring now to FIG. 3, the digital sampling step 40 includes a low pass filter 80 and an analog-to-digital converter 82. The time varying source voice signal, x(t), from speech source 14 is filtered by a low pass filter 80 with a cutoff frequency of 4.5 kHz. Then the signal is converted from an analog to a digital signal by using an analog to digital converter 82 (A/D converter) which derives the sequence x(n) by valuing x(t) at $t=nT=(n/f)$ where f is the sampling frequency of 10 kHz, T is the sampling period, and n increments from 0 to some count, $X-1$, at the end of a given source voice utterance interval.

Figure 4:
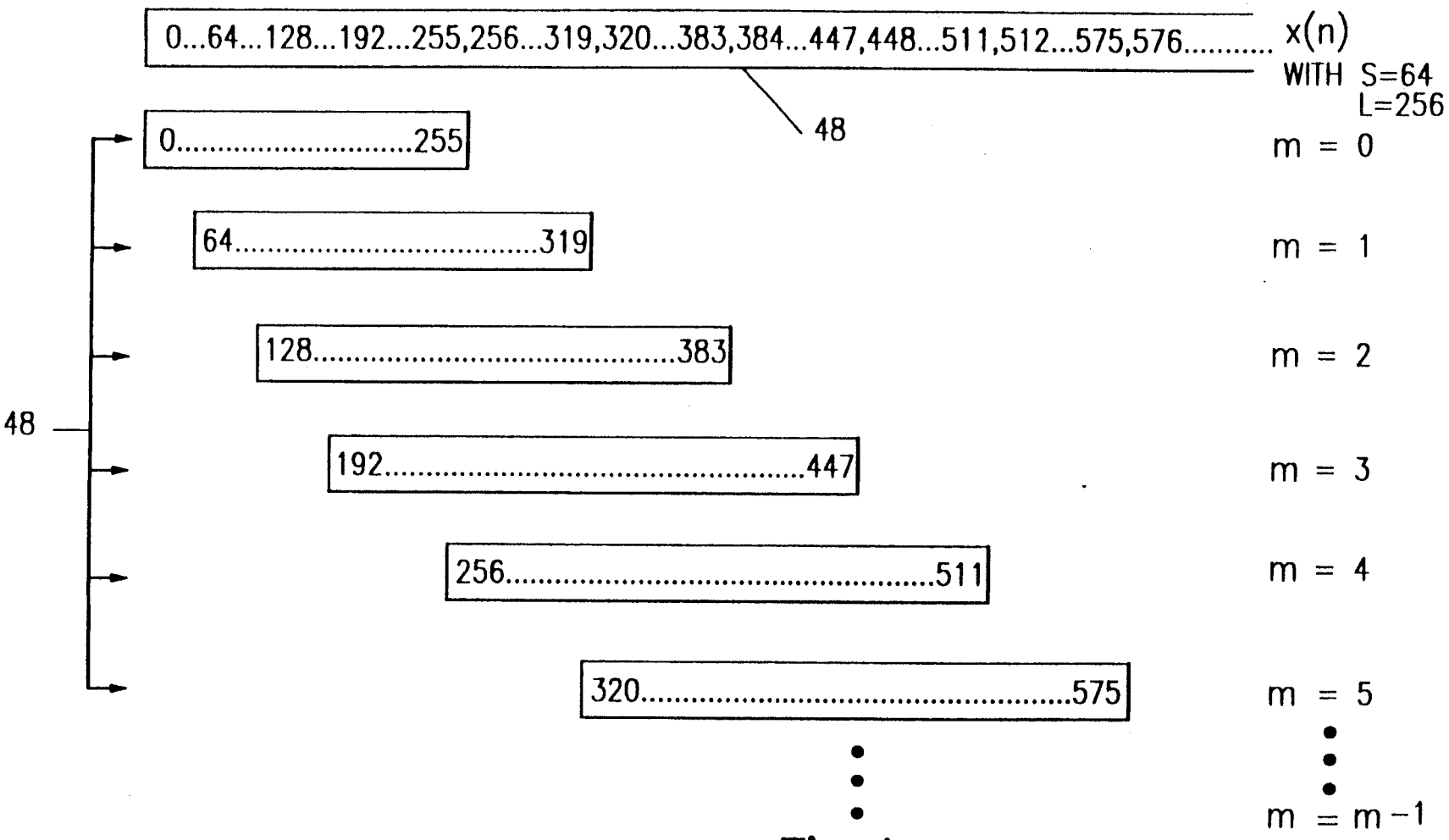
FIG. 4 is a pictorial representation of a segmentation of a sampled data signal.

As shown in FIG. 4, the sampled source voice signal, x(n), goes through a segmenting and windowing step 42 which breaks the signal into overlapping segments. Then the segments are windowed by a suitable windowing function such as a Hamming function illustrated in FIG. 5.

The combination of creating overlapping sequences of the speech signal and then windowing of these overlapping sequences at window function step 42 is used to isolate short segments of the speech signal by emphasizing a finite segment of the speech waveform in the vicinity of the sample and de-emphasizing the remainder of the waveform. Thus, the waveform in the time interval to be analyzed can be processed as if it were a short segment from a sustained sound with fixed properties. Also, the windowing function reduces the end point discontinuities when the windowed data is subjected to the discrete Fourier transformation (DFT) at step 44.

As illustrated in FIG. 4, the segmentation step 42 segments the discrete time signal into a plurality of overlapping segments or sections of the samples waveform 48 which segments are sequentially numbered from $m=0$ to $m=(M-1)$. Any specific sample can be identified as, $$X(mS,n)=X(n)|_{n=(mS,n')},\ 0\leqq n\leqq L-1 \tag{1}$$

In equation (1), S represents the numbers of samples in the time dimension by which each successive window is shifted, otherwise known as the window shift size, L is the window size, and mS defines the beginning sample of a segment. The variable n is the ordinate position of a data sample within the sampled source data and n' is the ordinate position of a data sample within a segment. Because each sample, x(n), is redundantly represented in four different quadrants of four overlapping segments, the original source data, x(n), can be reconstructed with minimal distortion. In the preferred embodiment the segment size is $L=256$ and the window shift size is $S=64$ or $\frac{1}{4}$ of the segment size.

Figure 5:
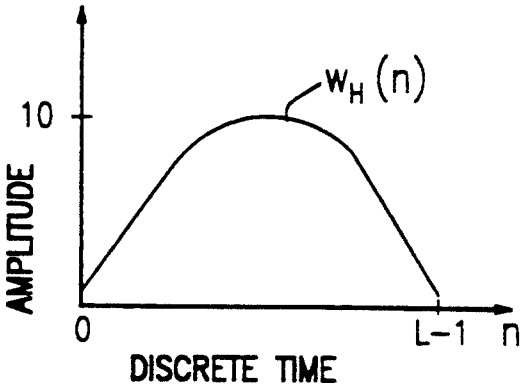
FIG. 5 is a graphical representation of a windowing function.

Now referring to FIG. 5, each segment is subjected to a conventional windowing function, w(n), which is preferably a Hamming window function. The window function is also indexed from mS (the start of each segment) so as to multiply the speech samples in each segment directly with the selected window function to produce windowed samples, $X_w$ (mS, n), in the time domain as follows:

$$X_W(mS,\ n)=X(mS,\ n)W(mS,\ n) \tag{2}$$

The Hamming window has the function, $$\begin{aligned} W_H(n) &= 0.54-0.46\cos\left[\frac{2\pi n}{L-1}\right],\ 0\leqq n\leqq L-1 \\ &= 0,\ \text{otherwise} \end{aligned} \tag{3}$$

The Hamming window reduces ripples at the expense of adding some distortion and produces a further smoothing of the spectrum. The Hamming window has tapered edges which allows periodic shifting of the analysis frame along an input signal without a large effect on the speech parameters created by pitch period boundary discontinuities or other sudden changes in the speech signal. Some alternative windowing functions are the Harming, Blackman, Bartlett, and Kaiser windows which each have known respective advantages and disadvantages.

The allowable window duration is limited by the desired time resolution which usually corresponds to the rate at which spectral changes occur in speech. Short windows are used when high time resolution is important and when the smoothing of spectral harmonics into wider frequency formats is desirable. Long windows are used when individual harmonics must be resolved. The window size, L, in the preferred embodiment is a 256 point speech segment having 10,000 samples per second. An L-point Hamming window requires a minimum time overlap of 4 to 1; thus, the sampling period (or window shift size), S, must be less than or equal to L/4 or $S \leqq 256/4 \leqq 64$ samples. To be sure that S is small enough to avoid time aliasing for the preferred embodiment a shift length of 64 samples has been chosen.

Each windowed frame is subjected to a DFT 44 in the form of a 512 Point fast Fourier transform (FFT) to create a frequency domain speech signal, $X_w(mS,k)$, $$X_w(mS,k) = \sum_{n=0}^{N-1} X(mS,n)W(mS,n)\, e^{-j(2\pi k/N)n)} \text{ where} \quad (4)$$

$$k = 0, \ldots, N-1$$

where K is frequency and the frame length, N, is preferably selected to be 512.

The exponential function in this equation is the short time Fourier transform (STFT) function which transforms the frame from the time domain to the frequency domain. The DFT is used instead of the standard Fourier transform so that the frequency variable, k, will only take on N discrete values where N corresponds to the frame length of the DFT. Since the DFT is invertible, no information about the signal x(n) during the window is lost in the representation, $X_w(mS,k)$, as long as the transform is sampled in frequency sufficiently often at N equally spaced values of k and the transform $X_w(mS,k)$ has no zero valued terms among its N terms. Low values for N result in short frequency domain functions or windows and DFTS using few points give poor frequency resolution since the window low pass filter is wide. Also, low values of segment length, L, yield good time resolution since the speech properties are averaged only over short time intervals. Large values of N, however, give poor time resolution and good frequency resolution. N must be large enough to minimize the interference of aliased copies of a segment on the copy of interest near n=0. As the DFT of x(n) provides information about how x(n) is composed of complex exponentials at different frequencies, the transform, $X_w(mS,k)$, is referred to as the spectrum of x(n). This time dependent DFT can be interpreted as a smoothed version Fourier transform of each windowed finite length speech segment.

The N values of the DFT, $X_W(mS,k)$, can be computed very efficiently by a set of computational algorithms known collectively as the fast Fourier transform (FFT) in a time roughly proportional to $N \log_2 N$ instead of the $4N^2$ real multiplications and $N(4N-2)$ real additions required by the DFT. These algorithms exploit both the symmetry and periodicity of the sequence $e^{-j(2\pi k/N)n}$. They also decompose the DFT computation into successively smaller DFTs. (See A. Oppenheim and R. Schafer, *Digital Signal Processing*, Prentice-Hall, 1975 (see especially pages 284–327) and L. Rabiner and R. Schafer, *Digital Processing of Speech Signals*, Prentice-Hall, 1978 (see especially pages 303–306) which are hereby incorporated by reference.

All of the DFT's in the preferred embodiment are actually performed by forming N-point sequences at step 50 and then executing an N point FFT at step 52. After application of the Hamming window function and prior to the STFT, each time domain segment of the source speech is padded with 256 zeros at the end of the 256 sample speech utterance interval in a framing step to form a frame having a length N=512. These additional zeroes will provide data for completing the last several window segments and will prevent aliasing when calculating the short time Fourier transform. In the preferred embodiment, a 512 point FFT is used. Therefore, the L point windowed speech segment, $X_w(mS,n)$, of 256 points must be padded at the end with 256 zeros to form the N=512 term frame in the time domain.

Following the STFT step 44 of FIG. 2, an LPC cepstrum parametrization step 46 is executed. A preferred technique for parametrization of speech is the method called linear predictive coding (LPC) which involves estimating the basic speech parameters of pitch, formants, spectra, and vocal tract area functions. Linear predictive analysis approximates a speech sample as a linear combination of past speech samples with the predictor coefficients representing weighting coefficients used by the linear combination. A final unique set of predictor coefficients is obtained by minimizing the sum of the squared differences between the actual speech samples and the linearly predicted ones over a set frame length.

Linear predictive coding techniques model a frame of speech by an all pole filter which approximates the vocal tract transfer characteristics. The vocal tract is an acoustic resonator with a time varying digital filter that has a steady state system response represented by the transfer function, H(z):

$$H(z) = [(z-z_1)(z-z_2)\ldots(z-z_m)/(z-p_1)(z-p_2)\ldots(z-p_n)] \quad (5)$$

$z_1, \ldots, z_m$ represents the system's zeroes and $p_1, \ldots, p_n$ represents the system's poles. The zeroes account for the nasal sounds in the speaker's voice, and the poles account for the resonances called formants.

This windowed speech for a single frame can be represented by a sequence of speech samples:

$$s(n),\ 0 \leqq n \leqq L-1 \quad (6)$$

The speech samples, s (n), relate to the system's excitation signal, u(n), by the difference equation:

$$s(n) = \sum_{k=1}^{p} a_k s(n-k) + Gu(n) \quad (7)$$

where $a_k$'s are the linear prediction coefficients and , G is the gain of the system's transfer function. The system's excitation, u(n), is either an impulse train for voiced speech or a random noise sequence for unvoiced speech.

A linear predictor, s(n), attempts to estimate s (n) from the previous p samples of the signal as defined by, $$s(n) = \sum_{k=1}^{p} a_k s(n-k) \tag{8}$$

again with prediction coefficients $a_k$. The number of samples, p, represents the order of the system function for linear predictive coding analysis. The system's prediction error, e(n), is defined as:

$$e(n) = s(n) - s(n) = s(n) - \sum_{k=1}^{p} a_k s(n-k) \tag{9}$$

S(z) represents the z-transform of the speech data for one frame which is to be modeled by the all-pole time varying digital filter of the form H(z)=G/A(z) with G again being the gain parameter of the system function, and A (z) representing the transfer function for which the prediction error sequence is the output. This prediction error filter, A(z), will be the inverse filter for the system H(z) which was defined above in equation 8. A(z) is determined from the equation, $$A(z) = \sum_{k=1}^{p+1} a_k z^{-k}, \text{ with } a_1 = 1 \tag{10}$$

H(z), the all pole transfer function, provides a reasonable representation of the sounds of speech and is equivalent to the pole/zero transfer function as long as the order of p is high enough.

Since the speech signal is time varying, the predictor coefficients must be estimated from short segments of the speech signal with the objective of minimizing the residual energy caused by the inexactness of the prediction. Residual energy, B, results from passing the transform of the speech samples, S(z), through an inverse filter, A(z), with the final energy expression represented as:

$$B = |S|^2 |A|^2 \tag{11}$$

$$Z = e^{j\phi} \tag{12}$$

where $\phi$ is a frequency parameter.

Equivalent to minimizing the residual energy is the method of minimizing the mean squared error over a short segment of speech. This method will result in a valid set of predictor coefficients that can act as the parameters of the system function, H(z). The mean squared error function, E, is of the form:

$$E = E\{e(n)\} = \sum_{n=0}^{L-1} e^2(n) \tag{13}$$

where e(n) is the system prediction error as defined in equation 11.

Taking the partial derivative of E with respect each of the 12th order LPC coefficients, $a_k$, k=1,2, . . . , p, results in the set of equations to solve for the predictor coefficients:

$$\sum_{k=1}^{p} a_k R(|i-k|) = R(i),\ 1 \leqq i \leqq p \tag{14}$$

Durbin's recursive procedure is described in L. Rabiner and R. Schafer's, *Digital Processing of Speech Signals,* Prentice-Hall, (1978), pp. 411–413. Durbin's recursive procedure has been devised for solving the system of equations reflected by equation 15. The equations can be rewritten into a matrix form with a p×p matrix of autocorrelation values which is symmetric with all of the elements on the diagonals being identical. Durbin's method exploits this Toeplitz nature of the matrix of coefficients and is solved recursively with the following equations:

For $$i = 1,2,\ldots,p: \tag{15}$$

$$E^{(0)} = R(0) \tag{16}$$

$$k_i = \left[ R(i) - \sum_{j=1}^{i-1} a_j^{(i-1)} R(i-j) \right] / E^{(i-1)},\ 1 \leqq i \leqq p \tag{17}$$

$$a_i^{(i)} = k_i \tag{18}$$

$$a_j^{(i)} = a_j^{(i-1)} - k_i a_{(i-j)}^{(i-1)},\ 1 \leqq j \leqq i-1 \tag{19}$$

$$E^{(i)} = (1 - k_i^2) E^{(i-1)} \tag{20}$$

The final solution of linear predictive coefficients is:

$$a_j = a_j^{(p)},\ 1 \leqq j \leqq p \tag{21}$$

with all of the parameters as previously defined.

The parameters $k_i$ used in Durbin's method are called the partial correlation coefficients (PARCOR coefficients). These parameters indicate the degree of correlation between the forward and backward prediction error. The prediction errors are calculated respectively by the previous and following i samples with i ranging from 1 to p. These partial correlation coefficients are equally as useful as the LPCs since they are equivalent to the set of predictor coefficients that minimize the mean squared forward prediction error. The PARCOR coefficients $k_i$ can be obtained from the set of LPC coefficients $a_i$ using the following backward recursion algorithm where i goes from p, to p - 1 down to 1:

Initially set $$a_j(p) = a_j,\ 1 \leqq j \leqq p \tag{22}$$

$$k_i = a_i^{(i)} \tag{23}$$

$$a_j^{(i-1)} = [a_j^{(i)} + a_i^{(i)} a_{(i-j)}^{(i)}] / [1 - k_i^2], \tag{24}$$

The log area ratio coefficients are another type of parameters which can be used to represent a voice signal. These coefficients are derived more easily from the PARCOR parameters, $k_i$, than from the LPC parameters, $a_k$. The method of prediction for the log area ratio coefficients, $g_i$, is more readily understood in terms of the corresponding areas of a tube representing the vocal tract, $A_i$, with the equivalencies in terms of the PARCOR coefficients. This is indicated in the following equation:

$$g_i = \log[A_{(i+1)}/A_i] = \log[(1-k_i)/(1+k_i)],\ 1 \leqq i \leqq p \tag{25}$$

These coefficients are equal to the log of the ratio of the areas of adjacent sections of a loss less tube. This tube is the equivalent of a vocal tract having the same transfer function H(z) defined by the LPC algorithm.

Thus, speech can be modeled as $$X_w(m,n) = \sum_{k=1}^{p} A_k X_w(m,n-k) + e(n) \tag{26}$$

-continued for $k = 1, 2, \ldots p$

In the above equation p is the order of the LPC model with 12 being preferred. $A_k$ are the LPC coefficients and e (n) is a white noise process.

The LPC coefficients are extracted from each windowed segment of speech using the autocorrelation method. Durbin's recursive method is used to solve the autocorrelation matrix equation.

The linear filter model is $$X(z) = \frac{1}{E(z)A(z)} \tag{27}$$

where $$A(z) = 1 - \sum_{k=1}^{p} a_k Z^{-k} \tag{28}$$

The LPC cepstrum is then derived from the LPC coefficients using the equations $$C_1 = a_1 \tag{29}$$

$$C_n = a_n + \sum_{k=1}^{n-1} (1 - {}^{k}/_{n}) a_k C_{n-k} \tag{30}$$

if $1 < n \leqq p$ $$C_n = \sum_{k=1}^{p} (1 - {}^{k}/_{n}) a_k C_{n-k} \tag{31}$$

if $p < R$

A set of coefficients $C_1$ through $C_{20}$ is found for each segment of speech data.

The smoothest spectrum, K (mS,k), is determined from the LPC cepstrum using the relationship, $$C(z) = \sum_{n=1}^{\infty} C_n Z^{n-z} = \ln \frac{1}{A(z)} \tag{32}$$

$$= \ln H(Z) \tag{33}$$

where the smooth spectrum is the inverse Z transform of H (Z). Then, $$C(e^{jwt}) = ln\ |K(mS,k) + j\ arg\ [K(mS,k)] \tag{34}$$

therefor, $$K(mS,k) = exp\ \{Re\ [C\ (e^{jwt})\ ]\} \tag{35}$$

where T is the sampling period. Only the first 20 coefficients, $C_1$ through $C_{20}$ are used to estimate the smoothed spectrum K(mS,k).

As illustrated in FIG. 2, the excitation spectrum E(k) is determined by deconvolving the smoothed spectrum K(mS,k) with the STFT representation of the full speech spectrum, $X_w$(mS,k). The excitation spectrum for any given speech segment is thus given by $$E(k) = \frac{X_w(mS,k)}{K(mS,k)} \tag{36}$$

where E(k) and $X_w$ (mS,k) may in general be complex.

The output of the analysis step 16 of FIG. 1 is thus an excitation spectrum E(k) that must still be frequency scaled and a smoothed frequency domain spectrum K(mS,k) that represents the vocal characteristics of a segment of sampled speech of the source speaker.

TRAINING STEP

Figure 6:
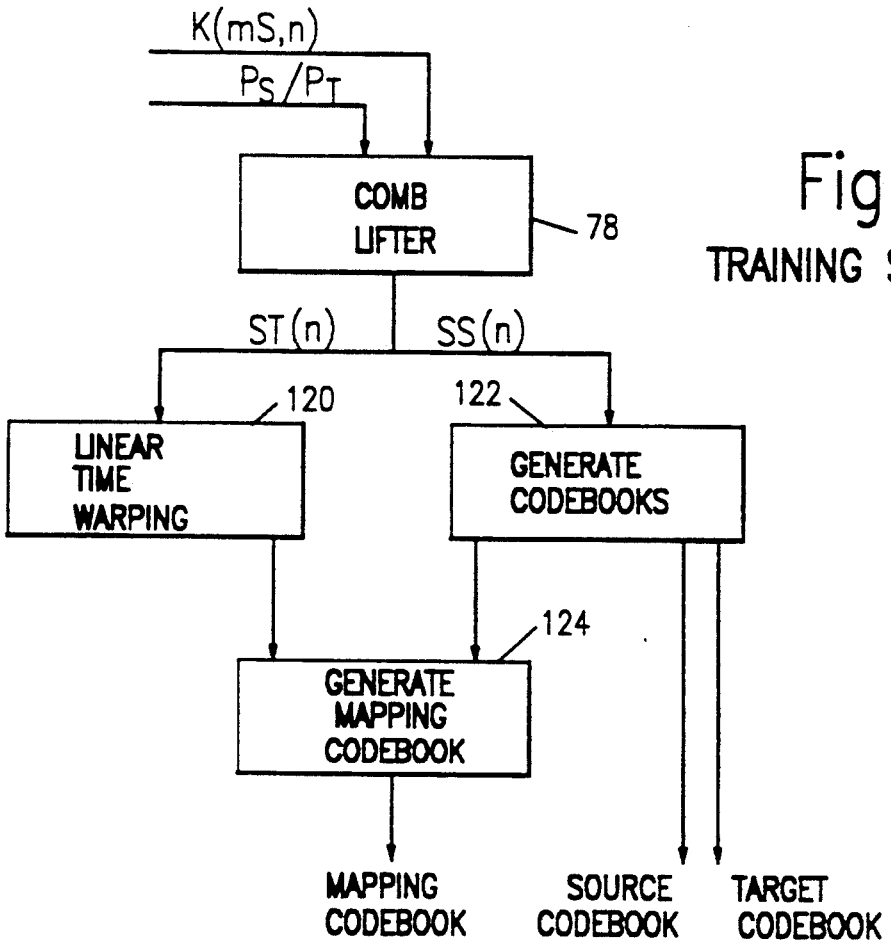
FIG. 6 is a block diagram representation of a training step used in a voice transformation processor shown in FIG. 2.

Referring now to FIGS. 2 and 6, both the target and source speakers speak identical, specified training sentences or samples. These speech samples, $X_t$(t) and $x_s$(t), are preprocessed as described above at steps 30 and 32. The smoothed spectrum K(mS,k) is presented to training step 54, as represented by LPC cepstrum coefficients.

Figure 7:
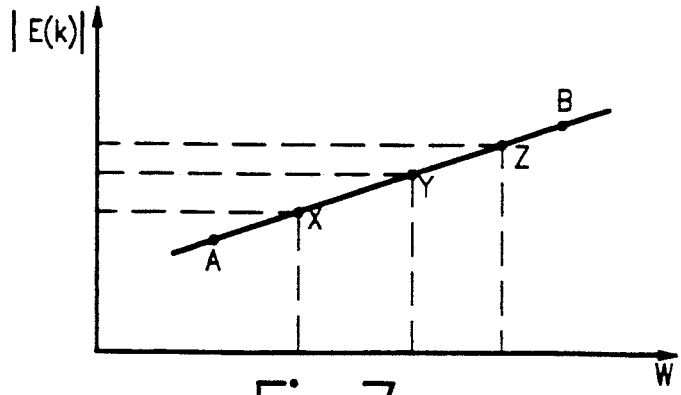
FIG. 7 is a graphical representation of interpolation of the magnitude of the excitation spectrum of a speech segment for linear pitch scaling.

These global change comb filtered cepstrum→LPC cepstrum coefficients are used in a pitch estimation step 50 shown in FIG. 7 to estimate both the average pitch periods, Ps and PT, and the average fundamental frequencies, $K_S$ and $K_T$, for both the source and the target training speech.

The modified cepstrum coefficient vectors from step 46 are used a generate code books step 122 for vector quantization of both the source's and target's training speech. Also, linear time warping 120 is used to determine which vectors, $S_T$(n), of the target's speech represent the same speech sounds in the training sentences as the source's vectors, $S_S$(n). After this correspondence is determined, a mapping code book is generated at step 124 which uses the linear time warping information to form a mapping between code words in the source's code book to the best corresponding code words in the target's code book. In all instances where distortion is calculated in the preferred embodiment, such as during code book generation, the same distance measure is used.

During the training step 54, a correspondence or mapping is established between the spectrum for source speech segments and the spectrum for those same segments as uttered by the target speaker. Following training, when arbitrary source speech is being transformed, each source speech spectrum is correlated with a most nearly matching training speech spectrum. The target speech spectrum that has been previously determined to correspond or map to the selected source training speech spectrum is then substituted for the source speech spectrum that is to be transformed.

The correlation of arbitrary source speech segment spectra with training speech segment spectra is accomplished by using the vectors representing the spectra to establish a position in multidimensional vector space. An arbitrary source speech segment spectrum is then correlated with a nearest training speech segment spectrum for the same speaker.

There are many options for distance calculation such as the squared error, Mahalanobis, and gain normalized Itakura-Saito distortion measures. The distance measure allows two frames of speech with different parametrized vector representations to be compared efficiently in a quantitative manner. If the distance measure is small, the distortion between the speech frames being compared is small, and the two frames are considered similar. If the distortion is large, the two frames are not considered similar. In the preferred embodiment, dynamic time warping is used to assure that segments of source training speech are correlated with segments of target training speech representing the same spoken sound.

The preferred embodiment employs a distance measure which is known as the squared error distortion measure. This distance measure is determined by calculating the difference in position of two vectors in the multidimensional vector space. The distance between two speech vectors is described as, $$d^2(x, y)=(x-y)^t W^t(x-y) \tag{37}$$

where d is the Euclidean distance, W equals the identity matrix, I; x and y are k-dimensional feature vectors representing the spectrum of a speech segment. Equation 28 produces the square of the Euclidean distance between the two vectors and can be alternatively written as:

$$d^2(x,y) = |x - y|^2 = \sum_{i=0}^{k-1} (x_i - y_i)^2 \tag{38}$$

where k is an index identifying each dimension of the spectrum of the segment. The advantage of this distance measure is that it is the easiest, simplest measure to use for distortion calculations.

If an LPC vector quantization analysis is used, the distortion measure should be consistent with the residual energy minimization concept of the analysis process. One of the possible distortion measures that complies with this requirement is the gain-normalized Itakura-Saito measure. For example, using the Itakura-Saito measure, X(z) is the z-transform of a frame of speech, and $\sqrt{\alpha_p}/A_p(z)$ is the optimal p-th order LPC model of X(z). The value of $\alpha_p$ represents the minimum residual energy obtained from inverse filtering X(z) with $A_p(z)$ where $1/A_p(z)$ is a p-th order all-pole filter as in standard LPC analysis. Inverse filtering X(z) with $A_p(z)$ will result in a residual error, $\alpha$, which is equal to, $$\alpha = \int_{-\pi}^{\pi} |X(e^{j\Phi})A(e^{j\Phi})|^2 \frac{d\Phi}{2\pi}, \text{ where } \alpha \geqq \alpha_p \tag{39}$$

where $\phi$ is a frequency parameter. The gain normalized Itakura-Saito distortion measure is defined for two unit gain modeled spectra as:

$$d\left[\frac{1}{A_p}, \frac{1}{A}\right] = \int_{-\pi}^{\pi} \frac{|A(e^{j\Phi})|^2}{|A_p(e^{j\Phi})|^2} \frac{d\Phi}{2\pi} - 1 = \frac{(\alpha)}{\alpha_p} - 1 \tag{40}$$

Minimizing this distance measure, d, is equivalent to minimizing the residual energy $\alpha$ since the minimum residual energy $\alpha_p$ only depends on the input. The actual calculation of d can be carried out in a more simplified manner where, $$d\left[\frac{1}{A_p}, \frac{1}{A}\right] = \frac{a^T V_p a}{a_p^T V_p a_p} - 1 \tag{41}$$

$$= \frac{a^T V_p a}{\alpha_p} - 1 \tag{42}$$

$$= a^T V^*_p a \tag{43}$$

$$= R^*_x(0)R_a(0) + 2\sum_{k=1}^{p} R^*_x(k)R_a(k) - 1 \tag{44}$$

where a represents a p-th order LPC coefficient vector of A(z), $a_p$ represents the p-th order LPC coefficient vector of $A_p(z)$, $R_x(k)$ is the autocorrelation coefficient of the frame of input X (z), $R_a(k)$ is the autocorrelation coefficient of a, $\alpha_p$ is the minimum residual energy computed for the frame of input X(z), $V_p$ represents the matrix $$\begin{bmatrix} R_x(0) & R_x(1) & \dots & R_x(p-1) \\ R_x(1) & R_x(0) & \dots & R_x(p-2) \\ . & . & \dots & . \\ R_x(p-1) & R_x(p-2) & \dots & R_x(0) \end{bmatrix}$$

$V^*_p$ is the gain normalized version of the $V_p$, and $R^*_x(k)$ is the gain normalized version of $R_x(k)$.

Each source speaker has a different average pitch in his or her voice. For example, women tend to speak with a higher pitch than men. While the pitch of any single segment sample may vary, over the course of a long speech utterance, each speaker will have a reasonably consistent average pitch. To properly transform the speech of a source speaker to that of a target speaker, the excitation spectrum of the source speech is pitch adjusted by linear scaling at step 58.

The pitch period of each segment can be determined by detecting periodically occurring large magnitude peaks in the smoothed LPC cepstrum. The reciprocal of this pitch period is the fundamental frequency of the speech segment.

During the training process the pitch is most reliably determined by manually examining a graphic representation of the speech signal on an amplitude vs. time plot of the speech sample.

During training the average pitch is determined for the source and target speakers. During a subsequent transformation of arbitrary speech, the ratio of the target and source pitches is used to change the pitch of the source speech to approximate the pitch of the target speaker at step 58.

During linear pitch scaling by the pitch adjustment step 58, the excitation spectrum, E(k), of each segment of speech is scaled linearly by the source to target pitch ratio.

The scaled excitation spectrum is determined as $$X_{wr}(mS,k) = E(k)\frac{W}{K} \tag{45}$$

where W is the frequency of the speech segment and K is the scale factor. Both the real and imaginary parts of the excitation spectrum are linearly scaled in frequency.

Since the excitation spectrum is computed only at a set of 256 discrete frequencies, $$Ew\left(m, \frac{nfs}{ZL}\right),$$

where L is 256 and fs is 1/T, interpolation is necessary to shift the spectrum by a factor greater than 1. For example, if the scaling factor is K=Z, to represent a transformation from a higher pitch to a lower pitch, then one interpolated spectrum point needs to be found between every pair of shifted spectral points. On a frequency scale, the original sample data points are spread farther apart by the linear scaling, therefore, additional sample data points must be established by interpolation. The interpolation method linearly interpolates the real part of the shifted spectrum as well as its magnitude and solves for the imaginary part.

Figure 8:
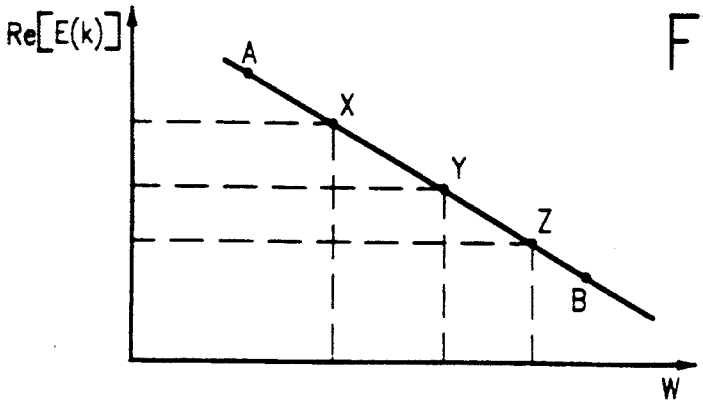
FIG. 8 is a graphical representation of interpolation of the real part of the excitation spectrum of a speech segment for linear pitch scaling.

In FIGS. 7 and 8, two points, A and B, are obtained by linearly scaling the magnitude and real parts respectively of the excitation spectrum along a frequency axis. The additional points x, y and z are obtained by linearly interpolating between A and B. The imaginary part of each of the points x, y and z is then determined using the equation (for the case of point X)

$$Im\,[X] = V\,|x^2| - (Re\,[x])^2 \tag{46}$$

The preferred technique for automated pitch detection is the simplified inverse filtering technique (SIFT). This pitch detection technique is described in L. Rabiner, M Cheng, A Rosenberg, and C McGonegal, "A Comparative Performance Study of Several Pitch Detection Algorithms" *IEEE Transactions on Acoustics, Speech, and Signal Processing,* Vol. 24, No. 5, (1976), pp. 399–404, which is hereby incorporated by reference.

The generation of a code book required by step 122 for the training procedure illustrated in FIG. 16 is shown in greater detail in FIG. 94. One code book is generated to represent the source speech vectors, $S_S(n)$, and another code book to represent the target speech vectors, $S_T(n)$. The code books are generated through an iterative design procedure which converges on a locally optimal code book where the average distortion measure is minimized across the training set. The basic idea of generating a code book is to take the large number of parametrized training speech samples and use some form of clustering algorithm to obtain a code book of code words that can represent all of the sample training speech within a preset distortion limit. Distortion in this situation is the distance between the training sample speech vectors, $S_S(n)$ or $S_T(n)$, and the code words, $\{A_S\}$ or $\{A_T\}$, which are the closest parameter models for the incoming feature vectors.

Separate code books are established for the spectral representation of the speech segments of both the source and target training speech sequences. The code books are generated in the same way for both the source and target training sequences. One of the described methods of code book generation is the full search, bit increment code book. Full search means that after the code book has been completed and is being used for each incoming speech segment, the distortion must be calculated to each code word in the code book to find the minimum distance. It is not possible to eliminate part of the code book from the search. Bit increment indicates that the code book starts out at a bit size of one for each code word and increases to a desired maximum bit size.

Figure 9:
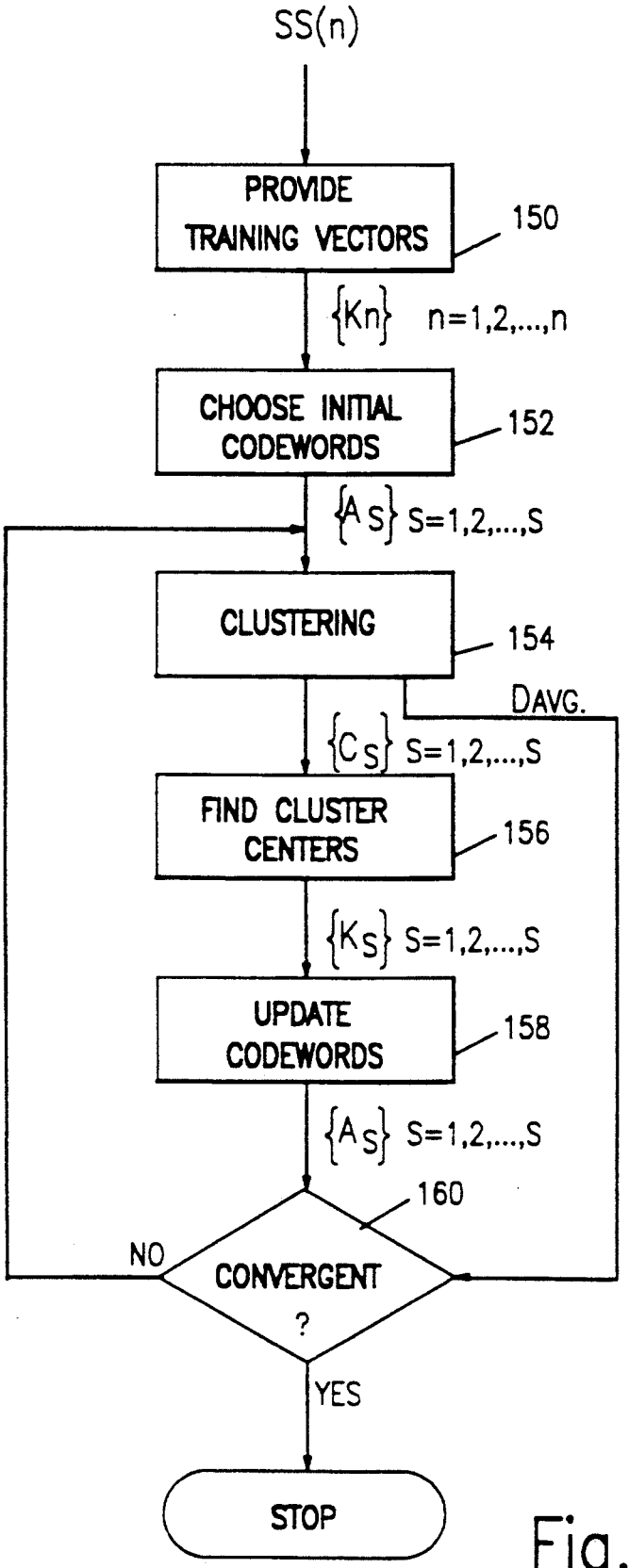
FIG. 9 is a block diagram representation of a code book generation step used by a training step shown in FIG. 2.

The preferred embodiment, however, uses an algorithm as depicted in FIG. 9. This algorithm starts with a simple code book of the correct size. The algorithm consists of the following steps used to describe the generation of the code book, which can be either the source or target code book, depending on the source of the data.

STEP 1. Provide Training Vectors 150, $\{k_n\}$, n=1,2, . . . N.

These training vectors are the vector representation of the source speech LPC cepstral coefficients, $S_S(n)$, which are calculated for each segment of the source speech as illustrated for analysis step 16 of FIGS. 1 and 2.

Choose Initial Code Words 152, $\{A_s\}$, s=1,2, . . . S.

This code book generation algorithm 122 searches for a globally optimum code book. The search is aided by a good choice for the initial code book. The simplest approach chooses the first S vectors in the training set. The preferred embodiment, however, randomly selects S vectors uniformly spaced in time to avoid the high degree of correlation between successive vectors in speech where the speech representation has a short segment length.

STEP 3. Clustering 154, $\{C_s\}$, s=1,2, . . . S; $D_{AVG.}$

Each initial code word $\{A_s\}$ in a code book is considered a cluster center. Each additional parametrized speech segment, $S_S(n)$, of the training speech is assigned to its most similar cluster center. For the preferred embodiment, the best matched cluster center is determined by calculating the squared error distortion measure between each parameter vector, $S_S(n)$, and each codeword, $\{A_s\}$, and choosing the codeword which returns the smallest distortion, $d(S_s(n), A_s)$. The cumulative average distortion, $D_{AVG.}$, of the code book is then determined by finding the vector distance from each code word to a nearest adjacent code word to get a distortion measure $d(S_S(n), A_s)$ for each code word. The average is then calculated by summing up the individual distortion measures, $d(S_S(n), A_s)$, from the code word for each speech segment and dividing by the number of training speech segments, $$D_{AVG.} = (1/M) \sum_{m=1}^{M} \min(d(S_S(n)_m, A_s)) \tag{47}$$

where M equals the number of training speech segments, $S_S(n)$ is a modified coefficient vector for a segment and $A_s$ is the nearest code word which is initially a vector representation of a speech segment.

STEP 4. Find Cluster Centers 156 $\{k_s\}$, s=1,2, . . . , S.

Replace each code word with the average of all vectors in the training speech set that mapped into that codeword. For the preferred embodiment, this average represents a centroid that is simply the vector sum of all input vectors mapped to a given code word divided by the number of input vectors.

$$k_s = (1/(\#\ vectors\ S_S(n)\ mapped\ to\ A_s))\ \Sigma\ S_S(n) \tag{48}$$

where all vectors $S_S(n)$ are mapped to $A_s$. The new code words better represent the training vectors mapping into the old code words, but they yield a different minimum distortion partition of the incoming training speech samples.

If a different distortion measure, such as the gain normalized Itakura-Saito distance measure, were used instead of the squared error distance measure, this computation would be calculated as the average of the gain normalized autocorrelation coefficient vectors mapped to each centroid instead of the average of the actual vectors.

STEP 5. Update Code Words 158, $\{A_s\}$, $s$=1,2, . . . , S.

Compute new code words from the cluster centers. In the case of the squared error distortion measure which is used in the preferred embodiment, the new code words are simply the cluster centers calculated in Step 4. Thus $\{A_s\} = \{k_s\}$ for s=1,2, . . . S. However, in the situation where the gain normalized Itakura-Saito measure is used, the new code words are determined by calculating the standard LPC all pole model for this average autocorrelation.

STEP 6. Comparator 110

The comparator will determine if enough iterations have taken place to have the code book converge to its optimum where the average distortion measure is minimized across the entire training speech, $$(D_{AVG.}-D_{AVG.,\ Last\ Iteration})/D_{AVG.}\leqq\delta \quad (49)$$

where $\delta$ is chosen to be 0.05, and the value of $D_{AVG.,\ Last\ Iteration}$ is stored in the comparator and initialized to zero for the first iteration.

If the variation of the average distortion of all training vectors is less than the threshold value, the code book generation procedure is stopped, and the final code book is determined. Otherwise replace $D_{AVG.}$, Last Iteration with the new average distortion, $D_{AVG.}$, which was calculated in equation 36, and begin the next iteration at Step 3.

The training algorithm 54 illustrated in FIGS. 2 and 6 uses a linear time warping step 120 to establish a mapping of each code word in the source code book to a code word in the target code book. The preferred embodiment utilizes a linear time warping algorithm (LTW) to form a mapping from the source's modified cepstrum parameter vectors for each frame of source speech, $S_S(n)$, to their corresponding target vectors, $S_T(n)$. The first step in this algorithm is to manually divide the words in both the source's and target's training speech into phonemes by visual inspection. Then the speech is passed through a mapping step with pointers from source speech frames to corresponding target speech frames being the output from this step.

Phonemes are individual speech sounds. American English has approximately 42 phonemes which can be divided into four categories: vowels, diphthongs, semivowels, and consonants. Each, of these categories can be subdivided in relation to the manner and place of articulation of the sound within the vocal tract. Each phoneme provides a very different periodic waveform which can be easily detected and separated from other phonemes during the phoneme stage of the LTW algorithm 120 shown in FIG. 6.

Each phoneme is represented by approximately four or five segments of parametrized speech. During the mapping step, these segments are visually compared by a training step operator. This operator must decide by visual comparison of source and target speech waveforms which of the target segments of speech best correspond to each segment of the source speech. The operator, however, does not face any restrictions on how many of the target segments may be matched to a single source frame. As long as the operator performs this mapping job correctly, the source and the target training speech should be mapped so that there are pointers from each source segment to at least one target segment that represents the same sound being spoken. Thus the timing fluctuations between the target and the source speech are eliminated. There is in effect a manual synchronization in case one speaker talks faster than the other.

The LTW algorithm produces the most accurate time alignment of the target and source training speech segments. The human operator is the best judge of which frames have the closest correspondence and is not restricted by arbitrary rules. However, in some cases, it is not possible to have an operator available. In this situation, a computer executed dynamic time warping algorithm (DTW) is useful for time aligning the training speech segments. This algorithm, however, can cause degradation to the quality of the voice transformer output since the DTW algorithm can sometimes inaccurately align the source and the target training speech segments.

The process of dynamic time warping is useful in dealing with difficulties that arise when comparing temporal patterns such as pitch and formant variations since two speakers are unable to speak at the same rate when repeating the same training phrases. The dynamic time warping algorithm models these time axis fluctuations that result from the comparison of the target test pattern of parametrized speech vectors called the test template with a reference template of the source feature vectors. The algorithm accomplishes this model by warping one pattern to gain maximum coincidence with the other. Some restrictions are applied which will serve to optimize the warping path and to reduce the number of computations. The correlation between source and target speech segments is formed by computing the minimized distance measure of the residual alignment differences. This problem can be formulated as a path finding problem over a finite grid of points.

The source and target training speech statements are each represented as a sequence of k-dimensional spectral parameter feature vectors, R(n) describing the characteristics of the $n^{th}$ segment of the same utterance. Each vector corresponds to a different speech segment. The source or reference utterance has the representation, $$R(n),\ n=1,2,\ldots,N \quad (50)$$

The corresponding target utterance has the representation, $$T(m),\ m=1,2,\ldots,M \quad (51)$$

where T(m) is a parameter feature vector which describes the $m^{th}$ frame of the target utterance. Since the purpose of the vocal tract parameter transformation is to find the target code word index for a segment of source speech, the source pattern is used as the reference and the target pattern is the one that is warped. N and M represent respectively the number of reference and test vectors of parametrized speech. The object of dynamic time warping is to find an optimal path $m=w_{opt}(n)$ in an (n,m) plane which minimizes a total distance function $D_T$, where, $$D_T=\sum_{n=1}^{N} d(R(n),T(w(n))) \quad (52)$$

The local distance d(R(n),T(w(n))) between frame $R_n$ of the reference pattern and frame $t_m=t_{w(n)}$ of the test pattern wherein m=w(n) can be any path allowed in the warping region, can be equal to any of the distortion measures such as the Euclidean, Mahalanobis, and Itakura distance measures discussed below with the Euclidean method being used in the Preferred Embodiment. The cumulative distance measure is the summation of all these local distortion values along the optimal path 114 in the feature space. Thus $D_T$ is the minimum distance measure corresponding to the best path, w(n), through a grid of allowable points 116. The similarity between the two templates is inversely proportional to their cumulative separation distance, $D_T$, in this $M\times N$ dimensional feature space.

This time warping of the two axes will work only if each segment of the test and reference utterances contributes equally to the cumulative distance. This means that no a priori knowledge is known about which sections of the speech templates contain more important information. Therefore, this single distance measure 118 applied uniformly across all frames should be sufficient for calculation of the best warping path.

Theoretically, the distortion between the test and reference frames for all of the M×N points on the grid must be calculated. This number can be reduced by using carefully selected constraints on the warping path 122 in the feature space thus restricting the number of matches between test and reference frames that must be computed. The warping path should also comply with some other restrictions such as arbitrarily assigned constraints on the endpoints of the phrases 124 and limitations on paths to a given point, (n,m), in the feature space 126.

A globally optimal warping path is also locally optimal; therefore, local continuity constraints that optimize the warping path 114 to a given point (n,m) will also optimize the warping path for the entire feature space. These local restrictions combine to serve the important function of limiting the position of the preceding point in relation to the current point on the path; thereby, limiting the degree of nonlinearity of the warping function.

The local constraints include the monotonicity and continuity constraints which result in restrictions to the local range of the path in the vicinity of the point (n,m). The optimal path to the grid point (n,m) depends only on values of n', m' such that $n' \leqq n$, $m' \leqq m$. Let m and n be designated by a common time axis, k, with both the time axes expressed as functions of k, $$n = i(k) \text{ and } m = j(k) = j(n) = w(n) \tag{53}$$

with consecutive points along the warping function represented as, $$p(k) = (i(k), j(k)) \tag{54}$$

The warping path, WP, therefore, can be represented as sequence of points, $$WP = p(1), p(2), \ldots, p(k), \ldots, p(K), \text{ K arbitrary} \tag{55}$$

along the warp path. For the monotonic requirement to be fulfilled, the following constraints must be complied with, $$i(k) \geqq i(k-1), \text{ and } j(k) \geqq j(k-1) \tag{56}$$

The continuity condition states that, $$i(k) - i(k-1) \leqq 1 \text{ and } j(k) - j(k-1) \leqq 1 \tag{57}$$

Because of these two restrictions for the path, any point, p(k), on the warping path must be preceded by a point p(k−1) which could be any of the following combinations:

$$p(k-1) = \begin{cases} \{i(k), (j(k)-1)\} \\ \{(i(k)-1), (j(k)-1)\} \\ \{(i(k)-1), j(k)\} \end{cases} \tag{58}$$

This limits the local range of the path to point (n,m) to be from either (n−1,m), (n−1,m−1), or (n,m−1). Further path restrictions are also possible as long as they comply with the monotonicity and continuity constraints. The most common local continuity constraints are:

$$p(k-1) = \begin{cases} \{(i(k)-1), j(k)\} \\ \{(i(k)-1), (j(k)-1)\} \\ \{(i(k)-1), (j(k)-2)\} \end{cases} \tag{59}$$

For these constraints, the warping function cannot change by more than 2 grid points at any index R. In terms of the warping function:

$$\begin{aligned} w(n+1) - w(n) &= 0,1,2 \text{ if } w(n) >< w(n-1) \\ &= 1,2 \text{ if } w(n) = w(n-1) \end{aligned} \tag{60}$$

Thus, w(n) will be monotonically increasing, with a maximum slope of 2, and a minimum slope of 0, except when the slope at the preceding frame was 0, in which case, the minimum slope is 1. These constraints insist that the reference index, M, advance at least one frame every two test frames and that at most, one reference frame can be skipped for each test frame.

These endpoint and continuing constraints constrain the warping function w(n) to lie within a parallelogram in the (n,m) plane.

The dynamic time warping algorithm assumes that the endpoints of the test and reference templates are approximately known. This is very difficult, especially for words beginning or ending with weak frictives (a frictive is when air is forced through openings of clenched teeth or lips generating noise to excite the vocal tract) since the segments corresponding to these frictives are often treated as silence. Utterances beginning with voiced sounds are usually easier to extract endpoints from so the phrase chosen to train the voice transformer is very important. In terms of i(k) and k) as defined above, the endpoints are constrained to be, $$w(1) = i(1) = j(1) = 1 \text{ as the beginning point} \tag{61}$$

$$w(N) = M;\ i(K) = N;\ j(K) = M \text{ as the ending point} \tag{62}$$

This will restrict the templates being compared in a manner such that the beginning and ending segments can be assumed to be in exact time registration.

Because of the local path constraints certain parts of the (n,m) plane are excluded from the region in which the optimal warping path can exist. These general boundaries 126 artificially limit the computation region, thus reducing the calculation requirements. They also place limits on the amount of expansion and compression of the time scales allowed by the dynamic time warping algorithm. With the maximum expansion denoted as $E_{max} = 1/E_{min}$, the general boundaries, with i (k) , the reference template, on the horizontal axis versus the test template, j(k), on the vertical time axis are:

$$1 + ((i(k)-1)/E_{max}) \leqq 1 + E_{max}(i(k)-1) \tag{63}$$

$$M + E_{max}(i(k)-N) \leqq j(k) \leqq M + ((i(k)-N)/E_{max}) \tag{64}$$

$$|i(k) - j(k)| \leqq R \tag{65}$$

with R representing the maximum allowable absolute time difference in frames between the test and reference patterns. Generally, $E_{max}$ is set at a value of 2.

Equation 52 can be interpreted as limiting the range to those grid points which can be reached via a legal path from the point (1,1), whereas equation 53 represents those points which have a legal path to the point (N,M).

Thus excessive compression or expansion of the time scales is avoided. The boundary conditions imply the ratio of instantaneous speed of the input utterance to that of the reference is bounded between $1/E_{max}$, the minimum expansion, and $E_{max}$, the maximum expansion, at every point.

The weighted summation of distances along the warping function for nonlinear alignment of a test and reference template represents the final distance measure for the best path in the feature space grid. Partial accumulated distance functions can be calculated for each point in the grid with each partial distance representing the accumulated distortion along the best path from point (1,1) to (n,m).

The distance measure can be rewritten in terms of i and j as, $$D = \sum_{k=1}^{K} d[\{i(k),j(k)\}]w(k) = \sum_{k=1}^{K} d\{p(k)\}w(k) \tag{66}$$

$$\text{with } d(p) = d(i,j) = d(R_i,T_j) \tag{67}$$

where d(i,j) could be either the Euclidean, Mahalanobis, or Itakura distortion measures. The weighing coefficient for a path from a preceding point to the current point will differ according to whether the path will take a symmetric or asymmetric form. An asymmetric form would indicate that the time normalization would be performed by transforming one axis into the other. This would possibly exclude some feature vectors from consideration. A symmetric form would imply that both the reference and test pattern axes would be transformed onto a temporary axis with weights equally on all of the feature vectors.

There is no difference in the value of the residual distance for the nonlinear time alignment when the local constraints and distance metric are symmetric. For this case the warping function has the form, $$w(k)=\{i(k)-i(k-1)\}+\{j(k)-j(k-1)\} \tag{68}$$

However, when there is asymmetry in the distance metric then it is significant whether the test or reference is along the x-axis as this will change the value of the warping function. The asymmetric form of the warping function will be, $$w(k)=\{i(k)-i(k-1)\}, \tag{69}$$

*for i(k) on the horizontal axis*

$$w(k)=\{j(k)-j(k-i)\}, \tag{70}$$

*for i (k) on the vertical axis*

Different weights may be applied to the local distance corresponding to which point precedes the current point. This can be represented by the following dynamic program algorithm for calculating D(R(n),T(w(n))) with the various constants $W_{top}$, $W_{mid}$, and $W_{rgt}$ having values corresponding to the desired form of the weighting coefficient.

For the preferred embodiment, a complete specification of the warping function results from a point-by-point measure of similarity between the reference contour R(n) and the test contour T(m). A similarity measure or distance function, D, must be defined for every pair of points (n,m) within a parallelogram that encompasses all possible paths from one point to the next. The smaller the value of D, the greater the similarity between R(n) and T(m). Given the distance function, D, the optimum dynamic path w is chosen to minimize the accumulated distance DT along the path:

$$D_T = \min_{\{w(n)\}} \sum_{n=1}^{N} D(R(n),T(w(n))) \tag{71}$$

Using dynamic programming in the preferred embodiments, the accumulated distance to any grid point (n,m) can be recursively determined, $$Da(n,m)=D(n,m)+\min Da(n-1,q), q\leqq m \tag{72}$$

where Da (n,m) is the minimum accumulated distance to the A grid point (n,m) and is of the form, $$Da(n,m) = \sum_{p=1}^{N} D(R(p),T(w(p))) \tag{73}$$

and q=m reflects that the path followed should be monotonic. Given the continuity constraints in equation 19 and equation 20, Da(n,m) can be written as, $$Da(n,m) = D(n,m) + \min \begin{matrix} Da(n-1,m)g(n-1,m) \\ Da(n-1,m-1) \\ Da(n-1,m-2) \end{matrix} \tag{74}$$

where g(n,m) is a weight of the form:

$$g(n,m) = \begin{matrix} 1, & w(n) >< w(n-1) \\ 0, & w(n) = w(n-1) \end{matrix} \tag{75}$$

g(n,m) represents a binary penalty for deviating from the linear path or for violating continuity constraints. In other words, g(n,m)=1 is for an acceptable path and g(n,m)=∞ for an unacceptable path.

The final solution $D_T$ of equation 31 is Da (N,M). The optional path $m=w_{opt}(n)$ is found by:

1. Letting P(n,m) contain the previous minimum path point (n−1, m*).
2. Deciding previous minimum path point, (n−1, m, ) from among three paths: (n−1, m), (n−1, m−1), and (n−1,M−2).
3. Find Da(n,m) and P(n,m) for the entire allowed region of the time warping path as in the allowable path parallelogram.
4. Trace P(n,m) backwards from n=N to n=1.
5. Use the following equations to compute the optimal time warping path $W_{opt}(n)$, $$m=W_{opt}(n)=M, \text{ for } n=N \tag{76}$$

$$m=W_{opt}(n)=P(n+1, W_{opt}(n+1)), \text{ for } n=N-1,N-2,\ldots 1 \tag{77}$$

Figure 10:
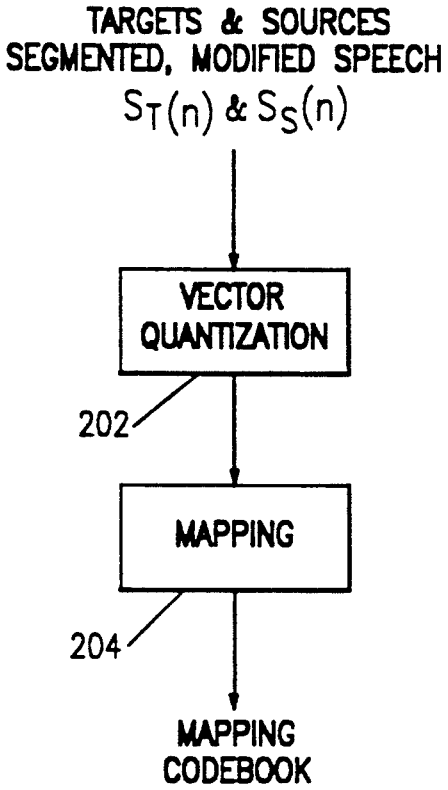
FIG. 10 is a block diagram representation of a generate mapping code book step used by a training step shown in FIG. 2.

The step of generating a mapping code book 124 of training algorithm 54 as shown in FIG. 6 is illustrated in FIG. 10. A mapping code book is generated using the information found in the code book generation and time warping stages. First a vector quantization (VQ) step 202 quantizes both the source and target training speech. After VQ, a mapping step 204 is executed to establish links in the form of a mapping code book between code words in the source code book and code words in the target code book.

As illustrated by the simplified diagram shown in FIG. 10, the vector quantization step 202 consists of calculating the best corresponding code word, $C_S(m)$, in the source code book for the source training speech segments, $S_S(n)$, and the best corresponding code word, $C_T(m)$, in the target code book for the target training speech segments, $S_T(n)$. Thus, after VQ, each segment of speech has a corresponding code word which can be represented by an index, m. Also during the VQ step 202, clusters are generated for each codeword in the source code book. These clusters consist of all of the training speech vectors, $S_S(n)$, which have been assigned to a specific code word after VQ has determined that the code word is the best model for the training speech vector in the cluster.

Figure 11:
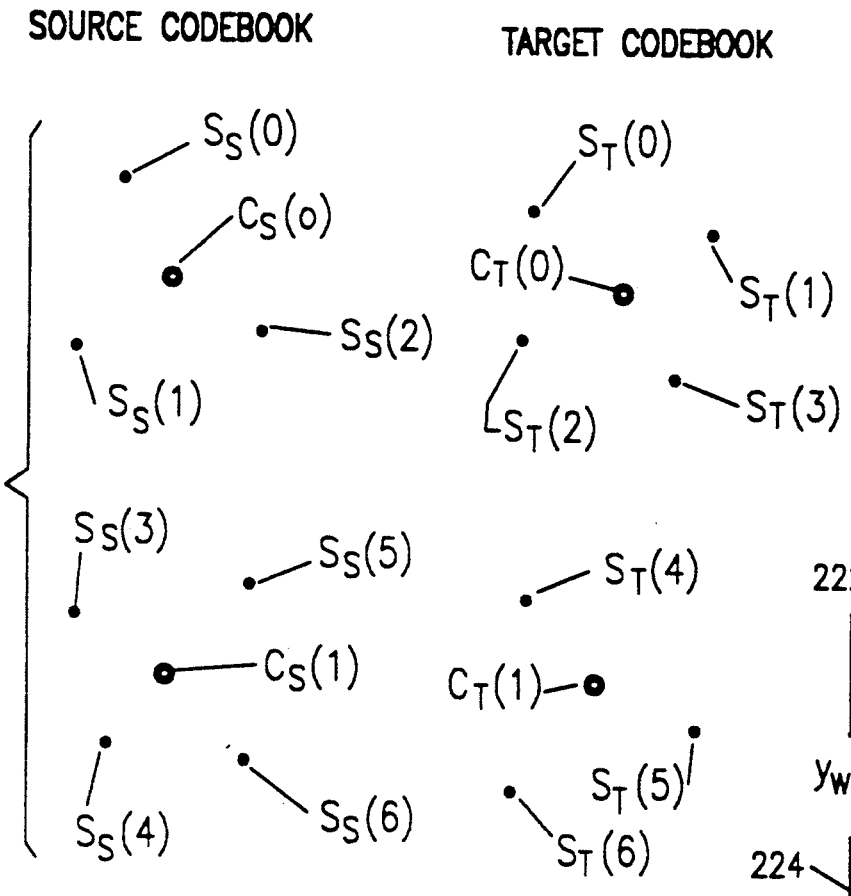
FIG. 11 is a pictorial representation useful in understanding the generate mapping code book step shown in FIG. 10.

In the illustrated example in FIG. 11, source speech vectors $S_S(0)$–$S_S(2)$ are clustered with code word $C_S(0)$ and vectors $S_S(3)$–$S_S(6)$ are clustered with code word $C_S(1)$. Similarly, for the target code book, target speech vectors $S_T(0)$–$S_T(2)$ are clustered with code word $C_T(0)$ while vectors $S_T(3)$–$S_T(6)$ are clustered with target code word $C_T(1)$.

The mapping step 204 uses the indexing and cluster information from the VQ stage 202 along with the mapping information from the time warping step to develop a mapping code book. For each code word in the source code book, there is a corresponding cluster of training speech vectors generated in the previous VQ step 202. For each of the vectors in a source speech code word cluster, the linear time warping pointer information is used to determine a corresponding target speech segment which is represented by a target vector, $S_T(n)$. Thus, each source code word has a cluster of source speech vectors, each of which corresponds to a cluster of target speech vectors having a target code word index, m.

The next step is to calculate which target codeword index is the most common for each source code word cluster. A tie would suggest an inadequate code book development. If a tie does occur, one of the contending target clusters can be arbitrarily selected. This most common code word cluster becomes the target cluster which is mapped to the source cluster. In this manner, each source cluster having a source code word is assigned a corresponding target cluster having a target code word. Thus, the final mapping code book will consist of a lookup table of source cluster indexes and their corresponding target cluster indexes.

In the transformation unit 34 of FIG. 2, the average fundamental frequencies of both the target and the source, $K_T$ and $K_S$, are used to form a modification factor R which is then used to convert the source pitch to the target baseline pitch by frequency scaling and interpolation of the source excitation spectrum.

The modification factor, R, is defined as the ratio of the source average pitch frequency to the desired target pitch frequency, which is the target average pitch frequency:

$$R = P_{TS}/P_{TT} \tag{78}$$

The average pitch frequency is determined during training. The source excitation spectrum is then frequency scaled by the constant ratio R which shifts the source pitch frequency to the target pitch frequency using the equation:

$$E_m = E_S'(mS,k) = E_S(mS,k/R),\ k=0,\ldots,N/-1 \tag{79}$$

The excitation spectrum E(mS,k) of each segment of speech is thus scaled linearly with respect to the frequency K.

It is then necessary to shift the excitation spectrum by interpolation as the scaled excitation spectrum $E_m$ is computed only at N2 discrete frequencies. Both the real and the imaginary components of the interpolated spectrum points are calculated and these interpolated spectrum points are found between each pair of scaled spectral values, $(k_i/R)$ and $(k_{i+1}/R)$ for $i=0,\ldots,N/2-2$. The real component of the new interpolated point is calculated as the average of the real components of the spectral values on either side of this new point:

$$Re[E(k_{(i+1)/2})] = \{Re[E(k_i/R)] + Re[E(k_{(i+1)}/R)]\}/2,\quad i = 0,\ldots,N/2-2 \tag{80}$$

The imaginary component of the interpolated spectrum point is calculated in two parts. First, the average magnitude is calculated:

$$|E(k_{(i+1)/2})| = \{|E(k_i/R)| + |E(k_{(i+1)}/R)|\}/2 \quad (81)\ i=0,\ldots,N/2-2$$

Then the imaginary part of the new spectrum point is calculated by finding the square root of the quantity equal to the difference of the squared value of the magnitude of the new point and the squared value of the real value of the new point:

$$Im[E(k_{(i+1)/2})] = [|[E(k_{(i+1)/2}/R)]|^2 - (Re[E(k_{(i+1)/2}/R)]^2]^{\frac{1}{2}}\quad i = 0,\ldots,(N/2)-2 \tag{82}$$

Finally, the new spectrum point is found by adding the real and imaginary components together:

$$E(k_{(i+1)/2}) = Re[E(k_{(i+1)/2})] + jIm[E(k_{(i+1)/2}) \tag{83}$$

In addition to scaling of the excitation spectrum, a nearest neighbor classifier is used to replace the source smoothed spectrum with the corresponding target smoothed spectrum for each segment. The parametrized representation of the source spectrum consists of the time domain vectors which are the modified cepstral coefficients, $S_S(n)$. This replacement is accomplished using the three code books developed during the training step 54. The three code books are a source code book, a mapping code book, and a target code book. For each incoming vector representation, $S_S(n_1)$, of the source smoothed speech spectrum, the source code word is selected that yields the minimum possible distortion. In the preferred embodiment, the distortion measure that is used for this selection is the squared error distortion measure. Thus, for each code word in the source code book, the square of the Euclidean distance between the code word and the speech vector is calculated, and the code word which provides the smallest distance value is selected. The index, m, for this code word is input into the mapping code book to get the corresponding index for a target code word which was mapped to this specific source code word during training. This target index is used to access a corresponding code word in the target code book. The target code word is then substituted for the source smooth spectrum vector.

Referring now to FIG. 2, the pitch shifted excitation spectrum, $E_{PA}(mS,k)$, is convolved at step 60 with the target spectral envelope vector, $K_T(mS,k)$, and the resulting spectrum is converted to the time domain by an IDFT at step 62. The voice transformed speech is then phase aligned by the inverse segmenting and windowing step 64, and the phase aligned transformed signal is reconstructed with a time duration adjustment at step 66 to produce a sequence, $X_T(n)$, of transformed source speech of the same time duration as the original source speech signal, X(n).

The inverse segmenting and windowing step 64 consists of recombining the segments while accounting for the previously shifted, overlapped segments to generate the window shift and overlap adding the modified time domain sampled data signal $X_T(n)$ representing the transformation of the source voice into the target voice. This recombining is necessary because the phase of the pitch shifted, interpolated speech output of the convolving step 60 is no longer continuous between successive speech segments. This phase alignment is accomplished by employing a variable window shift, S'. The original window shift, S, will be replaced by a ratio of the original window shift to the modification factor, R, which is the pitch frequency ratio that was used during the transformation step: $S'=S/R=S/(K_S/K_T)$. This results in a phase shifted, segmented signal $x_{W^t}(mS',n)$ These segments are then added together into a signal, $x^t(n)$, in a process called the overlap add method (OLA). The signal at time n is obtained by summing the values of all the individual segments, $x_{W^t}(mS',n)$, that overlap at time n.

SIGNAL RECONSTRUCTION WITH TIME DURATION ADJUSTMENT

The time duration adjustment step 66 is illustrated in greater detail in D. Griffin and J. Lim's least squares error estimation from the modified STFT (LSEE-MSTFTM) algorithm as described in Roucos, Salim and Wilgus, Alexander M., "High Quality Time-Scale Modification for Speech," *IEEE Transactions on Acoustics, Speech, and Signal Processing,* CH2118-8/85/0000-0493, pp. 493–496, 1985 which is hereby incorporated by reference. This method is used to reconstruct and adjust the time duration of the source transformed speech.

This algorithm is designed to enforce the equality of the STFT magnitudes (STFTM) of the original and rate modified signal, provided that these magnitudes are calculated at corresponding time points. The STFT contains both the spectral envelope and pitch information at discrete time points ($n_i$; i=1,2, . . . , N). Through an iterative process, the LSEE-MSTFTM algorithm produces successive signal estimates whose STFTMs are monotonically closer to the required STFTMs if the squared error distance measure is used. The final result is synthesized speech with approximately the same spectral envelope and pitch as the original signal when measured at the warped set of time points ($f(n_i)$; i=1,2, . . . , N).

In the preferred embodiment, the speech rate of the signal, $x_i(n)$ , is to be changed by a rational factor, $\alpha=S/S'$, to yield the rate-modified speech signal y(n). If $\alpha>1$, the speech rate is slowing, and if $\alpha<1$, the speech rate is increasing. The algorithm iteratively derives the signal $y_i(n)$ at the $i^{th}$ iteration whose STFTM measured every S samples is monotonically closer to the STFTM of $x_i(n)$ measured every S' samples. The algorithm iteratively applies the STFT, magnitude constraint and signal reconstruction steps to obtain the $i+1^{st}$ signal estimate, $y_{(i+1)}(n)$ , from the $i^{th}$ signal estimate, $x_i(n)$ .

The signal $x_i(n)$ is sent through an STFT step with the new window shift, S', to obtain transforms of the overlapping segments, $X_{iW}(mS',k)$. The initial value, y(n), of the voice transformed output speech is also segmented and transformed by an STFT that uses, however, the original window shift size, S. This segmented, transformed frequency domain representation, $Y_i(mS,k)$, of y(n) along with the magnitude, $|X_{iW}(mS',k)|$, of each of the signal $x_i(n)$ STFT segments is input into the magnitude constraint step 218.

The magnitude constraint step calculates the magnitude constraint with the following equation:

$$Y_{(i+1)}(mS,k) = |X_{W_i}(mS',k)| \frac{Y_i(mS,k)}{|Y_i(mS,k)|}, \quad 0 \leqq k \leqq N-1 \tag{84}$$

where $Y_{(i+1)}(mS,k)$ is the STFT of $y_i(n)$ at time mS. This step, therefore, modifies the STFT of $y_i(n)$ computed at once every S points to obtain a modified STFT $Y_i(mS,k)$ that has the same magnitude as $X_{W_i}(mS',k)$ and the same phase as $Y_i$.

The combination of the magnitude constraint step 218 and the least squares error estimation step ensures the convergence of successive estimates to the critical points of the magnitude distance function:

$$D(y(n),X_{W_i}) = \sum_{m=-\infty}^{\infty} (1/2\pi) \int_{-\pi}^{\pi} [|Y(mS,k)| - |X_{W_i}(mS,k)|]^2 dk \tag{85}$$

This distance function can be rewritten as:

$$D(y(n),X_{W_i}) = \sum_{m=-\infty}^{\infty} \sum_{l=-\infty}^{\infty} [y(mS,l) - x(mS,l)]^2 \tag{86}$$

Since equation 76 is in the quadratic form, minimization of this distance function consists of setting the gradient with respect to y(n) to zero and solving for y(n). The solution to minimizing this distance measure is similar to a weighted overlap add procedure and can be represented as:

$$y(n) = \frac{\sum_{m=-\infty}^{\infty} w(mS-n)y(mS,n)}{\sum_{m=-\infty}^{\infty} w^2(mS-n)} \tag{87}$$

where w(mS−n) is the Hamming window centered at t=mS.

As $Y_i$ is not generally a valid STFT, the least squares error estimation:

$$y_{(i+1)}(n) = \tag{88}$$

-continued $$\frac{\sum_{m=-\infty}^{\infty} w(mS-n)\,(1/2\pi)\sum_{k=0}^{N-1} Y_{(i+1)}(mS,k)\,e^{(j2\pi kn/N)}}{\sum_{m=-\infty}^{\infty} w^2(mS-n)},$$

for $0 \leqq n \leqq N-1$, is used to estimate a real signal that has the STFT closest to $Y_i$. The $(i+1)^{st}$ signal estimate is the actual least squares error estimate of the sequence of complex modified STFTs calculated during the magnitude constraint step. Since each inverse transform of a modified STFT is not necessarily time limited, the mean computation is a weighted overlap and add procedure on the windowed inverse transforms of the successive modified STFTs.

The LSEE-MSTFTM algorithm requires extensive computation and one way to reduce this computation is to reduce the number of iterations required by choosing a good initial estimate. An initial value for y(n), the duration adjusted, voice transformed output speech is determined based on the synchronized overlap and add algorithm (SOLA) discussed in the article by S. Roucos and A. Wilgus, "High Quality Time-Scale Modification for Speech," *IEEE International Conference on Acoustics, Speech and Signal Processing,* Vol. 30, No. 6, (December 1982), pp. 841–853, which is hereby incorporated by reference.

This initial value time aligns the successive windows with respect to signal similarity (magnitude and phase) before the least squares error, overlap and add step (equation 78), by minimizing the time domain crosscorrelation between successive windows. The new initial estimate is given by:

$$y^0(n) = \frac{\sum_{m=-\infty}^{\infty} w(mS-n)x^t[n-m(S-S')-k(m)]}{\sum_{m=-\infty}^{\infty} w^2(mS-n)}, \quad (89)$$

If k(m)=0, the equation is the same as equation 78. However, if k(m) is chosen to be the value of k that maximizes the normalized crosscorrelation between the $m^{th}$window of the waveform and the rate modified signal computed up to the $m-1^{st}$ window. The maximization of the crosscorrelation ensures that the overlap add procedure that occurs during signal reconstruction will be averaging the window of the waveform with the most similar region of the reconstructed signal as it exists at that point. The reconstructed signal, y(n), therefore, will not be exact; however, it will always be within the range of delays allowed in crosscorrelation maximization, $k_{max}$, of the ideal rate-modified signal. Usually with this estimate, the number of iterations required under the LSEE-MSTFTM algorithm ranges from zero to two as opposed to up to and sometimes greater than one hundred times that for the regular white noise initiation of y(n).

Figure 12:
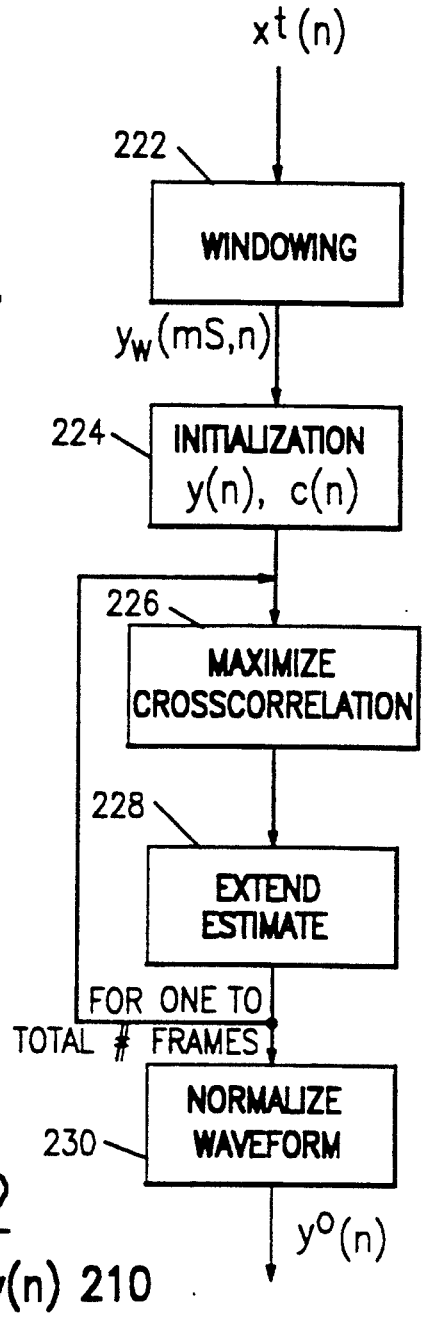
FIG. 12 is a block diagram representation of an initialize step used in the time duration adjustment step shown in FIG. 16.

The algorithm for calculating this initial value, $y_o(n)$ is as shown in FIG. 12. The incoming, overlap added, phase aligned, time domain signal, $x_t(n)$, is windowed at step 222 and the signal is represented by $y_W(mS,n)=w(mS-n)x_t[n-m(S-S')]$. Next, the initial values for y(n), which is the time duration aligned output signal and c(n) which is the normalization factor, are established at initialization step 224 with $y(n)=w(n)y_W(0,n)$ and $c(n)=w^2(n)$. Then the maximize crosscorrelation step 226 and extend estimate step 228 are repeated each time for the total number of frames. The crosscorrelation is maximized at step 226 by finding the k that maximizes:

$$RyyW(k) = \frac{\sum_{n=mS}^{mS+L} y(n)y_W(mS,n+k)}{\left|\sum_{n=mS}^{mS'+L} y^2(n)\sum_{n=mS}^{mS+L} y_{W2}(mS,n+k)\right|^{\frac{1}{2}}} \quad (90)$$

for $1 \leqq m \leqq L$; $-130 \leqq k \leqq -20$

The estimate is then extended by incorporating the $m^{th}$window:

$$y(n)=y(n)+2(mS+k-n)y_W(mS,n+k), for\ 1 \leqq m \leqq L \quad (91)$$

$$c(n)=c(n)+w^2(mS+k-n), for\ 1 \leqq m \leqq L \quad (92)$$

After these iterations, which allow for time alignment of successive windows before the overlap add algorithm, the new initial estimate waveform is normalized at step 230 using the equation:

$$y(n)=y(n)/c(n), for\ all\ n \quad (93)$$

The correction of linear phase in this initial estimate for y(n) reduces the number of iterations required for the signal reconstruction with time duration adjustment as the estimate reduces the distortion produced by the invariant overlap add step.

A source code listing of a developmental program for implementing this invention is set forth in Appendix A hereto.

While there have been shown and described above various embodiments of a voice transformation system for the purpose of enabling a person of ordinary skill in the art to make and use the invention, it will be appreciated that the invention is not limited thereto. Accordingly, any modifications, variations or equivalent arrangements within the scope of the attached claims should be considered to be within the scope of the invention.

VOICE TRANSFORMATION PROGRAM

Copyright © 1992 Walt Disney Imagineering

```
#include <stdio.h>
#include <math.h>
#include <sys/types.h>
#include <sys/dir.h>
#include <sys/stat.h>
#include "cepst_order"
```

```
#define  begin  {
#define  end    }

/*  order          : LPC analysis order.                                  */
/*  max_s_cbsize   : maximum source codebook size.                        */
/*  max_t_cbsize   : maximum target codebook size.                        */
/*  L              : window size.                                         */
/*  S              : window shift size.                                   */
/*  pm_factor      : pitch modification factor.                           */
/*  St             : window shift size for pitch modification.            */
/*  fft_size       : fft size.                                            */
/*  y_size         : input buffer size.                                   */
/*  x_size         : output buffer size.                                  */
/*  max_iterations : 20.                                                  */
/*  factor         : window scaling factor.                               */
/*  pi             : pi.                                                  */
/*  w0             : unit frequency.                                      */
/*  min_k          : minimum value of k for SOLA.                         */
/*  max_k          : maximum value of k for SOLA.                         */
/*  max_neighbors  : maximum number of neighbors for knn.                 */

#define        order                  12
#define        max_s_cbsize           512
#define        max_t_cbsize           512
#define        L                      256
#define        S                      64    /* Do not change. Must be integer */

/*
#define        St                     32      Must be integer
#define        pm_factor              2.0     NB: pm_factor = S/St
*/
#define        fft_size               512
#define        y_size                 50000
#define        x_size                 50000
#define        max_iterations         2
#define        factor                 2.0/sqrt(4.0*0.54*0.54+2.0*0.46*0.46)
#define        pi                     3.141592653
#define        w0                     2.0*pi/fft_size
#define        min_k                  20
#define        max_k                  110
#define        max_neighbors          10

static int St;
static float pm_factor;

main(argc,argv)
int argc;
char *argv[];
begin

/*********************************************************************/
/*                                                                   */
/*    VARIABLE LIST                                                  */
/*                                                                   */
/*    m              : window number.                                */
/*    num_samples    : number of frames in the data file.            */
/*    zero_frames    : zero frames on both sides of the analysis buffer. */
/*    M              : number of windows.                            */
/*    sync_k         : synchronization shift.                        */
/*    iteration      : iteration number.                             */
/*    s_cbsize       : source codebook size.                         */
/*    t_cbsize       : target codebook size.                         */
/*    cb_index       : target codeword index.                        */
/*    s_codebook     : source codebook.                              */
/*    t_codebook     : target codebook.                              */
/*    scale          : window scale.                                 */
/*    w              : window.                                       */
/*    inval          : one frame of speech data.                     */
/*    outval         : one frame of synthesized speech data.         */
/*    lp_frame       : LPC analysis frame.                           */
/*    R              : autocorrelation coefficients.                 */
/*    A              : LPC coefficients.                             */
/*    res_energy     : residual energy.                              */
/*    C              : LPC cepstrum.                                 */
/*    V              : vocal tract amgnitude spectrum from LPC cepstrum. */
/*    E              : excitation magnitude spectrum.                */
/*    scaled_V       : vocal tract magnitude spectrum by forman scaling. */
```

```
/*    index          : index for forman scaling.                          */
/*    y              : source speech signal.                              */
/*    x              : estimated signal.                                  */
/*    x_w            : windowed estimated signal.                         */
/*    x_ola          : overlap and add synthesis buffer.                  */
/*    weight         : weighting for window normalization.                */
/*    re             : real part of the speech data.                      */
/*    im             : imaginary part of the speech data.                 */
/*    X_re           : real part of the estimated signal (or spectrum).   */
/*    X_im           : imag part of the estimated signal (or spectrum).   */
/*    argX           : argument of the estimated signal spectrum.         */
/*    data_file      : speech data file.                                  */
/*    syn_file       : synthesized speech data file.                      */
/*                                                                        */
/**************************************************************************/

int    n, m, k, num_samples, zero_frames, M, sync_k, iteration;
int    t_cbsize, s_cbsize, cb_index, min_index;
int    map_cw[max_s_cbsize], knn[max_neighbors+1];
float  s_codebook[max_s_cbsize][cepst_order+1];
float  t_codebook[max_t_cbsize][cepst_order+1];
float  scale, w[L], scaled_E;
float  max, x_w_2, CR[max_k+1];
float  lp_frame[L+1], R[order+1], A[order+1], C[cepst_order+1], res_energy;
short  inval[S], outval[S];
float  V[fft_size], scaled_V[fft_size], E[fft_size], index;
float  y[y_size], x_w[L], x[x_size], x_ola[x_size], weight[x_size];
float  Y[2000][fft_size];
float  re[fft_size], im[fft_size], E_re[fft_size], E_im[fft_size];
float  argX[fft_size], X_re[fft_size], X_im[fft_size];
float  in_energy, out_energy, gain;
char   data_file[50], table_file[50], cb_file[50], syn_file[50];
FILE   *fp_data, *fp_table, *fp_cb, *fp_syn;
struct stat stbuf;


    printf("Enter desired pm_factor : ");
    scanf("%f",&pm_factor);

    /* First determine window shift size to approximate desired
       pm_factor  */
    St = (int) S/pm_factor;
    pm_factor = S/(float)St;
/*
    if (St>20)
        pm_factor = S/(float)St;
    else
        St=20;
*/

    printf("Actual pm_factor = %f\n",pm_factor);

    printf("Enter the source speech data file name\n");
    scanf("%s", data_file);

    printf("Enter the mapping table file name\n");
    scanf("%s", table_file);

    printf("Enter the target codebook file name\n");
    scanf("%s", cb_file);

    printf("Enter the transformed speech data file name\n");
    scanf("%s", syn_file);

    /* Find number of samples in data file */
    stat(data_file,&stbuf);
    num_samples = stbuf.st_size/2;
    printf ("Number of samples in %s = %d\n",data_file,num_samples);

    /*  Read in the mapping table.  */

    fp_table = fopen(table_file, "r");
        /* for (cb_index=1; cb_index<=s_cbsize; ++cb_index) */
        cb_index = 1;
        while (fscanf(fp_table, "%f", &s_codebook[cb_index][1]) == 1)
          begin
            for (k=2; k<=cepst_order; ++k)
```

```
          fscanf(fp_table, "%f", &s_codebook[cb_index][k]);
        fscanf(fp_table, "%d", &map_cw[cb_index]);
        cb_index++;
      end
    s_cbsize = cb_index - 1;
fclose (fp_table);
printf ("Source codebook size = %d \n",s_cbsize);


/*  Read in the target t_codebook.  */

fp_cb = fopen(cb_file, "r");
  /* for (cb_index=1; cb_index<=t_cbsize; ++cb_index)  */
  cb_index = 1;
  while (fscanf(fp_cb, "%f", &t_codebook[cb_index][1]) == 1)
    begin
      for (k=2; k<=cepst_order; ++k)
          fscanf(fp_cb, "%f", &t_codebook[cb_index][k]);
      cb_index++;
    end
  t_cbsize = cb_index - 1;
fclose(fp_cb);
printf ("Target codebook size = %d \n",t_cbsize);


/*  Initialize the analysis and synthesis window scale.  */

zero_frames = L/S - 1;
M = num_samples/S + zero_frames;
scale = factor*sqrt( (float)S/(float)L );
for (n=0; n<L; ++n)
    w[n] = 1.0;
modified_hamming(w, L, scale);


/*  Read in the speech data in the buffer.  */
fp_data = fopen(data_file, "rb");
for (m=0; m<M+zero_frames; ++m)
  if (m<zero_frames || m>=M)
    for (n=0; n<S; ++n)
      y[m*S+n] = 0.0;
  else
    begin
      fread(inval, sizeof(short), S, fp_data);
      for (n=0; n<S; ++n)
        y[m*S+n] = inval[n];
    end
fclose(fp_data);


/*  Reset the synthesis buffer.  */

for (n=0; n<(M+zero_frames)*St; ++n)
    x_ola[n] = weight[n] = 0.0;


/*  Provide the modified magnitude spectrum  */
/*  at each window shift.                     */

for (m=0; m<M; ++m)
  begin
    for (n=0; n<fft_size; ++n)
      begin
        im[n] = 0.0;
        if (n < L)
          re[n] = w[n]*y[m*S+n];
        else
          re[n] = 0.0;
      end
    for (n=0; n<L; ++n)
        lp_frame[n+1] = re[n];


    /*  Find the speech signal spectrum.  */

    FFTCalc (re, im, fft_size);
```

```
/*  Find the input energy.  */

in_energy = 0.0;
for (n=0; n<=fft_size/2; ++n)
  in_energy += re[n]*re[n] + im[n]*im[n];


/*  Find the vocal tract response magnitude spectrum  */
/*  from the LPC cepstrum.                             */
/*  Separate the vocal tract response and excitaion    */
/*  magnitude spectrum.                                */

auto_cor (lp_frame, L, R);
find_lpc (R, A, &res_energy);
find_cepstrum (A, C, cepst_order);
for (n=0; n<=fft_size/2; ++n)
  begin
    V[n] = 0.0;
    for (k=1; k<=cepst_order; ++k)
      V[n] += C[k]*cos(k*n*w0);
    V[n] = exp(V[n]);
    E_re[n] = re[n]/V[n];
    E_im[n] = im[n]/V[n];
  end
/*  Modify the vocal tract response by substitution.  */

/*  Find the nearest neighbor and mapped target codeword.  */
/*  Obtain the target vocal tract response spectrum.  */

find_knn (C, s_codebook, s_cbsize, 1, knn);
min_index = map_cw[knn[1]];
for (k=1; k<=cepst_order; ++k)
    C[k] = t_codebook[min_index][k];
for (n=0; n<=fft_size/2; ++n)
  begin
    V[n] = 0.0;
    for (k=1; k<=cepst_order; ++k)
      V[n] += C[k]*cos(k*n*w0);
    V[n] = exp(V[n]);
  end


/*  Modify the excitation spectrum by the scaling factor.  */
/*  Construct the modified speech signal spectrum.         */
/*  Compute the output energy.                             */

/*  Note: modification is for range of 0 - pi.      */
/*        the rest half is obtained by lower half.  */

out_energy = 0.0;
for (n=0; n<=fft_size/2; ++n)
  begin
    index = n/pm_factor;
    scaled_E = E_re[(int)index] + (index-(int)index)
               *(E_re[(int)index+1] - E_re[(int)index]);
    re[n] = scaled_E*V[n];
    scaled_E = E_im[(int)index] + (index-(int)index)
               *(E_im[(int)index+1] - E_im[(int)index]);
    im[n] = scaled_E*V[n];

    out_energy += re[n]*re[n] + im[n]*im[n];
  end


/*  Find the gain and rescale the modified spectrum.  */

gain = sqrt(in_energy/out_energy);
for (n=0; n<=fft_size/2; ++n)
  begin
    re[n] *= gain;
    im[n] *= gain;
  end


/*  Find the rest half of the spectrum.  */
```

```
for (n=fft_size/2+1; n<fft_size; ++n)
  begin
    re[n] = re[fft_size-n];
    im[n] = -im[fft_size-n];
  end


/*  Compute the estimated signal.  */

FFTInvCalc (re, im, fft_size);
    /*  Overlap and add with synthesis window.          */
    /*  Phase adjustment by changing window shift size.  */

    for (n=0; n<L; ++n)
      begin
        x_ola[m*St+n] += w[n]*re[n];
        weight[m*St+n] += w[n]*w[n];
      end
  end


/*  Rescale the synthesized signal by window normalization.  */
/*  and by the pitch modification factor.                    */

for (n=0; n<(M+zero_frames)*St; ++n)
    x_ola[n] *= pm_factor/weight[n];



/*  Time scale modification for duration adjustment.  */


/*  Read in the speech data in the buffer.  */

for (n=0; n<(M+zero_frames)*St; ++n)
    y[n] = x_ola[n];


/*  Initialization for synchronized initial estimation.  */

for (n=0; n<(M+zero_frames)*S; ++n)
    x[n] = weight[n] = 0.0;
for (n=0; n<L; ++n)
  begin
    x[n] = w[n]*w[n]*y[n];
    weight[n] = w[n]*w[n];
  end


/*  Synchronized initial estimation.  */

for (m=1; m<M; ++m)
  begin

    /*  Provide the original signal with window.  */

    for (n=0; n<L; ++n)
      x_w[n] = w[n]*y[m*St+n];


    /*  Find crosscorrelation between x and x_w.  */

    max = -1000.0;
    for (k=min_k; k<=max_k; ++k)
      begin

        /*  The scale factor in the denominator.  */

        x_w_2 = 0.0;
        for (n=m*S; n<m*S+L; ++n)
          if (n-m*S-k >= 0)
            x_w_2 += x_w[n-m*S-k]*x_w[n-m*S-k];
        x_w_2 = sqrt(x_w_2);
```

```
        /*  Compute the crosscorrelation.  */

        CR[k] = 0.0;
         for (n=m*S; n<m*S+L; ++n)
           if (n-m*S-k >= 0)
             CR[k] += x[n]*x_w[n-m*S-k];
         CR[k] /= x_w_2;


         /*  Find max CR[k].  */

         if (CR[k]>max)
           begin
             max = CR[k];
             sync_k = k;
           end
       end


      /*  Extend the estimate by incoorporating the m-th window.  */

      for (n=m*S+sync_k; n<m*S+sync_k+L; ++n)
        begin
          x[n] += w[n-m*S-sync_k]*x_w[n-m*S-sync_k];
          weight[n] += w[n-m*S-sync_k]*w[n-m*S-sync_k];
        end
    end

  /*  Rescaling the initial estimate.  */

  for (n=0; n<(M+zero_frames)*S; ++n)
      x[n] /= weight[n];


  /*  Provide the magnitude spectrums at each window shift.  */

  for (m=0; m<M; ++m)
    begin
      for (n=0; n<fft_size; ++n)
        begin
          im[n] = 0.0;
          if (n < L)
            re[n] = w[n]*y[m*St+n];
          else
            re[n] = 0.0;
        end
      FFTCalc (re, im, fft_size);
      for (n=0; n<fft_size; ++n)
         Y[m][n] = sqrt(re[n]*re[n] + im[n]*im[n]);
    end


  /*  Iterative procedure.  */


  /*  Initialization for iterative procedure.  */

  iteration = 0;
  for (n=0; n<(M+zero_frames)*S; ++n)
      x_ola[n] = weight[n] = 0.0;

again:
    ++iteration;

for (m=0; m<M; ++m)
  begin

    /*  Find the estimated signal spectrum.  */

    for (n=0; n<fft_size; ++n)
      begin
        im[n] = 0.0;
        if (n < L)
          re[n] = w[n]*x[m*S+n];
```

```
        else
          re[n] = 0.0;
      end

    /*  Replace the magnitude with the reference magnitude. */
    /*  But keep the phase.                                  */

    FFTCalc (re, im, fft_size);
    for (n=0; n<fft_size; ++n)
      begin
        argX[n] = atan2(im[n], re[n]);
        X_re[n] = Y[m][n]*cos(argX[n]);
        X_im[n] = Y[m][n]*sin(argX[n]);
      end


    /*  Compute the estimated signal.  */

    FFTInvCalc (X_re, X_im, fft_size);


    /*  Overlap and add with synthesis window.  */

    for (n=0; n<L; ++n)
      begin
        x_ola[m*S+n] += w[n]*X_re[n];
        weight[m*S+n] += w[n]*w[n];
    end
  end


/*  Update the synthesis buffer.                                  */
/*  Rescale the synthesized signal by window normalization.  */

for (n=0; n<(M+zero_frames)*S; ++n)
  begin
    x[n] = x_ola[n]/weight[n];
    x_ola[n] = weight[n] = 0.0;
  end


/*  Check the number of iterations.  */

if (iteration < max_iterations)
  goto again;


/*  Save the synthesized speech data.  */

fp_syn = fopen(syn_file, "wb");
for (m=0; m<M-zero_frames; ++m)
  begin
    for (n=0; n<S; ++n)
      outval[n] = x[(m+zero_frames)*S+n];
    fwrite(outval, sizeof(short), S, fp_syn);
  end

    fclose(fp_syn);
end
```

What is claimed is:

1. For use with a costume depicting a character having a defined voice with a pre-established voice characteristic, a voice transformation system comprising:

a microphone that is positionable to receive and transduce speech that is spoken by a person wearing the costume into a source speech signal;

a mask that is positionable to cover the mouth of the person wearing the costume to muffle the speech of the person wearing the costume to tend to prevent communication of the speech beyond the costume, the mask enabling placement of the microphone between the mouth and the mask;

a speaker disposed on or within the costume to broadcast acoustic waves carrying speech in the defined voice of the character depicted by the costume; and a voice transformation device coupled to receive the signal from the microphone representing source speech spoken by a person wearing the costume, the voice transformation device transforming the received source speech signal to a target speech signal representing the utterances of the source speech signals in the defined voice of the character depicted by the costume;

wherein the voice transformation device stores a plurality of representations of the defined voice and transforms the voice of the person wearing the costume into the same defined voice of the character depicted by the costume, based upon association of the voice of the particular person with particular ones of the stored representations.

2. A voice transformation system according to claim 1, wherein the voice transformation device includes:

a processing subsystem segmenting and windowing the received source speech signal to generate a sequence of preprocessed speech signal segments;

an analysis subsystem processing the received preprocessed speech signal segments to generate for each segment a pitch signal indicating a dominant pitch of the segment, a frequency domain vector representing a smoothed frequency characteristic of the segment and an excitation signal representing excitation characteristics of the segment;

a transformation subsystem storing target frequency domain vectors that are representative of the target speech, substituting a corresponding target frequency domain vector for the frequency domain vector derived by the analysis subsystem, adjusting the pitch of the target excitation spectrum in response to the pitch signal derived by the analysis subsystem, and convolving the substituted target frequency domain vector with the adjusted excitation spectrum to produce a segmented frequency domain representation of the target voice; and a post processing subsystem performing an inverse Fourier transform and an inverse segmenting and windowing operation on each segmented frequency domain representation of the target voice to generate a time domain signal representing the source speech in the voice of the character depicted by the costume.

3. A voice transformation system comprising:

a preprocessing subsystem receiving a source voice signal and digitizing and segmenting the source voice signal to generate a segmented time domain signal;

an analysis subsystem responding to each segment of the segmented time domain signal by generating a source speech pitch signal representative of a pitch thereof, an excitation signal representative of the excitation thereof and a source vector that is representative of a smoothed spectrum of the segment;

a transformation subsystem storing a plurality of source and target vectors and voice pitch indications for the source voice and a target voice different from the source voice, a correspondence between the source and target vectors and the source and target voice pitch indications, the transformation subsystem using the stored information to substitute a target vector for each received source vector, adjusting the pitch of the frequency domain excitation spectrum in response to the source and target pitch indications to generate a pitch adjusted excitation spectrum, and convolving the pitch adjusted excitation spectrum with a signal represented by the substituted target vector to generate a sequence of segmented target voice segments defining a segmented target voice signal; and a post processing subsystem converting the segmented target voice signal into a segmented time domain target voice signal that represents the words of the source signal with vocal characteristics of the different target voice.

4. A voice transformation system according to claim 3, wherein the preprocessing subsystem includes a digitizing sampling circuit that samples the source voice signal to produce digital samples that are representative thereof and a segmenting and windowing circuit that devices the digital samples into overlapping segments having a shift distance of at most ¼ of a segment and applies a windowing function to each segment that reduces aliasing during a subsequent transformation to the frequency domain to produce a sequence of windowed source segments.

5. A voice transformation system according to claim 4, wherein each of the segments represent 256 voice samples.

6. A voice transformation system according to claim 3, wherein the analysis subsystem includes:

a discrete Fourier transform unit generating a frequency domain representation of each segment;

an LPC cepstrum parametrization unit generating source cepstrum coefficient voice vectors representing a smoothed spectrum of each frequency domain segment;

an inverse convolution unit deconvolving each frequency domain segment with the smoothed cepstrum coefficient representation thereof to produce the excitation signal in the form of a frequency domain excitation spectrum;

a pitch adjustment unit responding to the source speech pitch signal and adjusting the pitch of the excitation spectrum to generate a pitch adjusted excitation spectrum;

a substitution unit substituting target cepstrum coefficient voice vectors for the source cepstrum coefficient voice vectors for each corresponding segment; and a convolver convolving the pitch adjusted excitation spectrum with the substituted target cepstrum coefficient voice vectors.

7. A voice transformation system according to claim 3, wherein the transformation subsystem includes:

a store storing the target voice pitch information, a plurality of the target vectors, a plurality of the source vectors and the correspondence between the source and target vectors;

a pitch adjustment unit adjusting the pitch of the frequency domain excitation spectrum to generate a pitch adjusted excitation spectrum;

a substitution unit receiving source vectors and responsive to the stored voice and target vectors and substituting one of the stored target vectors for each received source vector; and a convolver convolving each substituted target vector with the corresponding pitch adjusted excitation spectrum to generate a segmented frequency domain target voice signal.

8. A voice transformation system according to claim 3, wherein the post processing subsystem includes:

an inverse Fourier transform unit transforming the segmented target voice signal to the segmented time domain target voice signal;

an inverse segmenting and windowing unit converting the segmented time domain target voice signal to a sampled nonsegmented target voice signal; and a time duration adjustment unit adjusting the time duration of representations of the sampled nonsegmented target voice signal.

9. A voice transformation system according to claim 8, further comprising a digital-to-analog converter converting the time duration adjusted sampled nonsegmented target voice signal to a continuous time varying signal representing spoken utterances of the source voice with acoustical characteristics of the target voice.

10. A method of transforming a source signal representing a source voice to a target signal representing a target voice comprising the steps of:

preprocessing the source signal to produce a time domain sampled and segmented source signal in response thereto;

analyzing the sampled and segmented source signal, the analysis including executing a transformation of the source signal to the frequency domain, generating a cepstrum vector representation of a smoothed spectrum of each segment of the source signal, generating an excitation signal representing the excitation of each segment of the source signal, determining a pitch for each segment of the source signal, and adjusting the excitation signal for each segment of the source signal in response to the pitch for each segment of the source signal;

transforming each segment by storing cepstrum vectors representing target speech and corresponding cepstrum vectors representing source speech, substituting a stored target speech cepstrum vector for an analyzed source cepstrum vector and convolving the substituted target cepstrum vector with the excitation signal to generate a target segmented frequency domain signal; and post processing the target segmented frequency domain signal to provide transformation to the time domain and inverse segmentation to generate the target voice signal.

11. For use with a costume depicting a predefined character having a voice with a pre-established voice characteristic, a voice transformation system comprising:

a microphone that is positionable to receive and transduce speech that is spoken by a person wearing the costume into a source speech signal;

a mask that is positionable to cover the mouth of the person wearing the costume to muffle the speech of the person wearing the costume to tent to prevent communication of the speech beyond the costume, the mask enabling placement of the microphone between the mouth and the mask;

a speaker disposed on or within the costume to broadcast acoustic waves carrying speech in the voice of the character depicted by the costume; and a voice transformation device coupled to receive the signal from the microphone representing source speech spoken by a person wearing the costume, the voice transformation device transforming the received source speech signal to a target speech signal by replacing vocal characteristics of the speaker, represented by the signal, with predefined and stored substitute vocal characteristics of the voice of the character depicted by the costume, the target speech signal being communication to the speaker to be transduced and acoustically broadcast by the speaker.

* * * * *